US008228257B2

(12) United States Patent
Lalezari

(10) Patent No.: US 8,228,257 B2
(45) Date of Patent: Jul. 24, 2012

(54) BROADBAND ANTENNA SYSTEM ALLOWING MULTIPLE STACKED COLLINEAR DEVICES

(75) Inventor: Farzin Lalezari, Boulder, CO (US)

(73) Assignee: FIRST RF Corporation, Boulder, CO (US)

( * ) Notice: Subject to any disclaimer, the term of this patent is extended or adjusted under 35 U.S.C. 154(b) by 796 days.

(21) Appl. No.: 12/408,259

(22) Filed: Mar. 20, 2009

(65) Prior Publication Data

US 2009/0237314 A1 Sep. 24, 2009

Related U.S. Application Data

(60) Provisional application No. 61/064,725, filed on Mar. 21, 2008.

(51) Int. Cl.

| | |
|---|---|
| ***H01Q 1/50*** | (2006.01) |
| ***H01Q 9/16*** | (2006.01) |
| ***H01Q 9/28*** | (2006.01) |
| ***H01Q 1/48*** | (2006.01) |
| ***H01Q 21/00*** | (2006.01) |

(52) U.S. Cl. ..... 343/850; 343/821; 343/859; 343/863; 343/857; 343/792; 343/801; 343/807; 343/856; 343/893

(58) Field of Classification Search ..... 343/821, 343/850, 859, 863, 857, 792, 801, 807, 846, 343/893, 790, 791

See application file for complete search history.

(56) References Cited

U.S. PATENT DOCUMENTS

| | | | | |
|---|---|---|---|---|
| 2,175,252 A | | 10/1939 | Carter | |
| 2,416,698 A | | 3/1947 | King | |
| 2,471,021 A | | 5/1949 | Bradley | |
| 2,543,130 A | | 2/1951 | Robertson | |
| 2,605,412 A | * | 7/1952 | Riblet | 343/792 |
| 3,159,838 A | * | 12/1964 | Facchine | 343/792 |
| 3,401,387 A | * | 9/1968 | Milligan et al. | 343/767 |
| 3,588,903 A | * | 6/1971 | Hampton | 343/792 |
| 3,605,099 A | | 9/1971 | Griffith | |
| 3,727,231 A | | 4/1973 | Galloway et al. | |
| 3,750,184 A | * | 7/1973 | Kuecken | 343/792 |

(Continued)

OTHER PUBLICATIONS

Notaros, B. M., Djordjevic, M. and Popovic, Z., "Generalized CoCo Antennas," Antenna Applications Symposium, Sep. 20-22, 2006, University of Illinois, Monticello, Illinois.

*Primary Examiner* — Jacob Y Choi
*Assistant Examiner* — Graham Smith
(74) *Attorney, Agent, or Firm* — IntelleTech PLLC; Katharine I. Matthews

(57) ABSTRACT

A broadband antenna system is disclosed. The antenna system relates to a modified conical structure, wherein the feed region of the cone is cut away to form a hollow "coneless" cylinder, and the distribution of one or more tapered feed points around the circumference of the cylinder allows a plurality of feed lines, cables, piping, or other structures to be run through the center of the antenna without interfering with the performance of the antenna system. The invention further relates to a stacked broadband antenna system wherein additional coneless elements, as well as other types of antennas or devices, may be stacked collinearly on, or disposed coaxially to, the cylindrical antenna structure, and fed, powered or operated via the plurality of feed lines, cables, piping or other structures. The overall system may thus provide a wide range of transmitting, receiving, sensing and other capabilities. By stacking a plurality of coneless elements with other antennas, the antenna system of the present invention may provide a virtually infinite bandwidth.

30 Claims, 17 Drawing Sheets

U.S. PATENT DOCUMENTS

| | | | | |
|---|---|---|---|---|
| 4,225,869 | A | 9/1980 | Lohrmann | |
| 4,410,893 | A | 10/1983 | Griffee | |
| 4,477,812 | A | 10/1984 | Frisbee, Jr. et al. | |
| 4,642,650 | A * | 2/1987 | Morton | 343/745 |
| 5,534,880 | A | 7/1996 | Button et al. | |
| 5,872,546 | A * | 2/1999 | Ihara et al. | 343/795 |
| 6,268,834 | B1 | 7/2001 | Josypenko | |
| 6,593,892 | B2 * | 7/2003 | Honda et al. | 343/773 |
| 6,809,686 | B2 * | 10/2004 | Du et al. | 343/700 MS |
| 6,864,853 | B2 | 3/2005 | Judd et al. | |
| 6,947,006 | B2 | 9/2005 | Diximus et al. | |
| 7,170,463 | B1 * | 1/2007 | Seavey | 343/793 |
| 7,339,542 | B2 * | 3/2008 | Lalezari | 343/773 |
| 2008/0143629 | A1 | 6/2008 | Apostolos | |

* cited by examiner

BROADBAND ANTENNA SYSTEM ALLOWING MULTIPLE STACKED COLLINEAR DEVICES

CROSS REFERENCE TO RELATED APPLICATIONS

This application is related to and claims the benefit of prior-filed U.S. Provisional Application for Patent Ser. No. 61/064,725 filed on 21 Mar. 2008, entitled "Modified Conical Antenna System Allowing Multiple Stacked Collinear Elements," which is incorporated herein by reference.

FIELD OF THE INVENTION

The present invention relates to a broadband antenna system, and more particularly, to a modified conical antenna structure wherein the feed region is cut away to form a substantially cylindrical shape termed herein "coneless." The enlarged feed region and distribution of tapered feed points around the circumference of the "coneless" cylinder permit the collinear and coaxial stacking of multiple antenna elements or other devices. The additional antennas or other devices may be disposed within or stacked on the shaped antenna structure without interfering with the performance of the antenna system, thus providing a wide range of sensing, transmitting, receiving and other capabilities for the overall system. Multiple feed lines, cables, piping, tubing or other structures may be run through the hollow center of one or more coneless elements to feed, power or operate the stacked devices. By combining one or more coneless elements with other antennas, the antenna system of the present invention may provide a virtually infinite bandwidth.

BACKGROUND OF THE INVENTION

Monocone and bicone (also termed biconical herein) antennas are well-known in the art. Many variations on the basic design of the monocone (cone, feed and ground plane) and bicone (pair of cones, feed and balun, with or without ground plane) are known. Applicant has developed an innovative "coneless" design that provides comparable or better performance relative to the known monocone and bicone antennas. The coneless design preserves the desirable performance of a conical antenna, but achieves advancement in antenna capability that has been desired, but not realized, for many years. The present invention is a simple, robust and inexpensive multifunctional antenna system that provides high gain over a large bandwidth. The innovative shape of the feed region of the present invention, having "tapered feed points" disposed substantially at the circumference of the cylindrical antenna structure, opens up the typical conic tip region of known monocone and bicone designs. The one or more tapered feed points replace the single feed/single conic tip that typically feeds known monocone antennas or the single feed/two conic tips of known bicone antennas. For optimal performance, the circumferential spacing of the tapered feed points is less than half a wavelength at the highest frequency of operation.

In order to improve bandwidth coverage, as well as gain, it is well-known to combine multiple antennas. Applicant has previously disclosed an ultra-broadband antenna system (U.S. Pat. No. 7,339,542, assigned to Assignee of the present invention) that combines an asymmetrical dipole (covering intermediate frequencies), fed with a biconical dipole (covering high frequencies), that together act as a monopole (covering low frequencies), all in a single tubular structure. The design of U.S. Pat. No. 7,339,542, including the use of a choke to limit interference, resulted in an ultra-broadband antenna system with a frequency span greater than 500:1. Nonetheless, this antenna system was limited by the very small opening in the conic tips of the biconical dipole, which resulted in coupling and interference. In order to combine additional elements with this ultra-broadband antenna system, Applicant has applied the coneless shape of the herein-described monocone to the biconical antenna element. The cut-away or shaped design of the feed region of the present invention opens up the typical "cone" of the prior art conical antennas, making a larger opening in the center of the antenna structure. Indeed, the diameter of the coneless element is substantially as large as that of the cylinder of the tubular antenna structure. This allows antenna feed lines or a wide variety of cables, such as coaxial, power, digital, fiber optic, wire, etc., as well as piping, tubing, actuators or other structures, to be run through the center of the antenna with minimal to no interference with the standalone antenna performance. For the biconical antenna of the present invention, the coneless elements may be aligned, or the elements may be clocked to improve performance in azimuth.

Another approach to providing wider bandwidth and improving gain has been to stack biconical radiators. Those skilled in the art have long studied the cone angle, overall length of the antenna, and diameter of the biconical elements in attempts to provide impedance matching of the antenna elements. An unsolved problem has been providing the feed to the stacked biconical structures without interfering with the RF performance of the lower biconical element. The innovative design of the present invention provides the same impedance matching and RF performance of known single feed point biconical structures, by positioning the one or more tapered feed points on the circumference of the cylindrical feed region. Stacking two coneless biconical elements results in higher gain at a given bandwidth; the present invention allows stacking of three, four or even more coneless biconical elements, for even higher gain, which provides the advantages of both increased range and reduced power requirements. To provide a wider frequency range, elements of differing diameters and/or differing length may also be stacked, without degradation in performance of the individual elements. At the same time that it provides greater bandwidth and/or higher gain, the innovation of present invention can allow reduction in the size of the antenna system, such as height, footprint, or diameter, or allow the system to be made conformal.

Thus, the innovative design of the coneless elements not only provides the physical space for feed lines to be run through the center of the tubular antenna structure, it also allows a wide range of devices to transmit and receive RF, audio, video and other optical frequencies, or other signals without interfering with the performance of the antenna system. In addition, non-electrical feeds, such as hydraulic, pneumatic and mechanical controls or actuators, and gas, liquid or solid material transfer systems, may also be run through the center of the antenna without degrading performance. The innovation of the present invention thus has many practical applications. Devices such as cameras, IR sensors, GPS devices, lights, audio equipment, radar equipment and communications equipment all may be mounted on the top of a multiple element, tubular antenna system that has a relatively small footprint. Where preferable, such devices may also be mounted in between multiple antenna elements. In many situations, this may obviate the need for multiple (separate) antennas, which otherwise would have to be placed apart in order not to interfere with each other.

By allowing the collinear and coaxial stacking of multiple antennas, the present invention is able to provide an antenna system with virtually unlimited bandwidth. Further, the present invention allows for both directional and omni-directional coverage, depending on the type of antennas combined.

Applications for the present invention, allowing for a wide variety of multiple stacked antennas and/or other devices, include placement on land vehicles, ships, planes, helicopters or spacecraft; land-based or sea-based locations; as well as man-portable uses.

The known art of antennas is voluminous. Applicant believes that the present invention may distinguished from the relevant prior art as follows. Typical known conical and biconical antennas, exemplified by the work of Carter, such as U.S. Pat. No. 2,175,252, disclose a single conical feed point that excites the cone-shaped radiator, which may be a single cone disposed above ground, or two cones about the same axis forming a bicone. The conical shape provides an impedance appearing almost as a pure resistance, or has no reactive component with variation in frequency, thus is useful over a wide frequency range. U.S. Pat. No. 2,416,698 to King discloses a single biconical with one feed point, having a hollow central cylinder. U.S. Pat. No. 2,543,130 to Robertson discloses yet another early biconical antenna, having a hollow pipe guide connected to a horn-shaped radiator for improved impedance matching. Like the present invention, monocones and bicones give broadband performance. Unlike the present invention, however, the foregoing designs do not permit the stacking of multiple antenna elements or other devices, because feed lines or cables cannot be run from the hollow central elements through the feed region without causing interference.

Another type of known antenna which does permit stacked collinear elements employs a traveling wave feed system. U.S. Pat. No. 2,471,021 to Bradley discloses a plurality of stacked biconical horn antennas, which use a driving network to couple into a circular wave guide through symmetrically arranged slots. U.S. Pat. No. 3,605,099 to Griffith discloses an antenna with stacked pairs of frustoconical reflector elements attached to a central hollow support member containing a central conductor. Feed is via traveling wave transmission through slots, connecting adjustable probes between the slots and the central conductor. U.S. Pat. No. 4,225,869 to Lohrmann discloses a multicone antenna having ¼ wavelength cones at each slot of a slotted ring antenna. U.S. Pat. No. 6,593,892 to Honda et al. discloses stacked biconical elements with a single center feed line. This class of antennas can be relatively broadband, and permit stacking of collinear biconical elements. The feed method of such systems is fundamentally different from that of the present invention, however, as the traveling wave is not an independent direct feed to each element. Further, all antennas using traveling wave feed are roughly the same type and size, whereas the present invention may combine a wide range of different antennas and different devices. Although traveling wave antenna systems potentially could accommodate additional devices in the collinear array by running cables or piping through the central conductor, energy is bled off as it proceeds through the slotted structure and therefore the feed to each element is not isolated, as is the case in the present invention. The functionality is limited because it does not have full control over phase and amplitude weighting. This approach also does not allow the ability to use antennas that perform at different frequency bands or perform independently of each other.

An alternate approach that allows stacking of antenna elements is to choke the antenna feed or route the feed externally. U.S. Pat. No. 3,727,231 to Galloway et al. discloses a collinear dipole array antenna with independent feeds using a narrowband technique which connects a coaxial cable to an external transmission line, in combination with $\lambda/4$ chokes for isolation, allowing a maximum of two elements.

U.S. Pat. No. 4,410,893 to Griffee discloses a collinear dual dipole antenna, also using a narrowband technique to jump the gap between two biconicals. U.S. Pat. No. 5,534,880 to Button et al. discloses multiple stacked bicone antennas with a bundle of transmission lines helically wound about the cylindrical periphery of the biconical antennas. This design uses exterior routing of cable to minimize the interference problems of passing the cables up the central column. U.S. Pat. No. 6,268,834 to Josypenko discloses multiple bicone antennas wherein the feed cable is led to a center point, then directed radially along the cone to an inductive short, through the inductive short, then directed along the surface of another cone to the center line. Again, this exterior routing of the cables minimizes the pattern perturbation. As exemplified by the foregoing, such designs do allow stacked elements and do have direct feeds to the antenna elements, but unlike the present invention, employ either a choked, centrally-fed system that permits only a relatively narrowband performance, or an externally-routed feed system for broader band operation.

U.S. Pat. No. 7,170,463 to Seavey discloses a broadband communications antenna system with center-fed, stacked dipole elements having conical shaped feed points and isolated with ferrite chokes (coiled inductors across the junction). The chokes are in close proximity to the actual feed, thus reducing the radiation efficiency of the antenna system. U.S. Patent Application Publication No. 2008/0143629 to Apostolos discloses a coaxial multi-band antenna combining a VHF, a UHF and a satellite antenna on a common radiating element, using meander line or ferrite chokes to isolate the feeds for each antenna. Unlike the narrowband choked designs of Galloway and Griffee, Seavey's and Apostolos' systems are relatively broadband, like that of Applicant's U.S. Pat. No. 7,339,542. The design of the present invention, however, obviates the need for chokes to isolate the feeds for stacked elements, thus is an improvement over all choked configurations and provides significantly greater efficiency and bandwidth.

In yet another approach, stacked, collinear and relatively broadband antenna systems are made possible by using waveguide structures to provide independent separate feeds to the antenna elements. U.S. Pat. No. 4,477,812 to Frisbee, Jr. et al. discloses a collinear array receiver system with a dipole antenna mounted atop the array. Using slot excitation, however, a system such as Frisbee, Jr.'s must be electrically large, on the order of tens of wavelengths, in order to allow space for transmission via slot. The present invention, in comparison, is on the order of one wavelength, and therefore provides the desired performance using a greatly reduced footprint. U.S. Pat. No. 6,864,853 to Judd et al. discloses stacked elements (a dipole combined with patch antenna elements) in a unitary structure that provides both directional and omnidirectional beam coverage, as well as a stack of bi-conical elements each having a frusto-conical reflector portion that together form a central passageway containing a feed system of coaxial cables. The omnidirectional array of bi-conical antennas configured end-to-end appears to use a waveguide feed structure, that, again, would be electrically large. Like the foregoing, the present invention utilizes independent separate feeds for each antenna element, but does not require the electrically large conical radiators of these waveguide-fed structures.

Finally, the prior art includes another antenna type that allows stacking of coaxial and collinear antennas. Termed "CoCo" antennas, these systems incorporate the feed system as part of the radiating structure. Examples are found in U.S. Pat. No. 6,947,006 to Diximus et al., which discloses a stacked collinear narrowband antenna that radiates on the transmission line structure, and in the 2006 paper "Generalized CoCo Antennas" by B. Notaroš, M. Djordjević and Z. Popović, which presents recent contributions to the theory and design of transmission-line antennas. This paper notes that the "CoCo antenna is inherently narrowband, and as such intended for practically single-frequency operation," and therefore has a very different functionality from the present invention. As well, the feed mechanism of CoCo antennas is distinct from that of the present invention, which as described above, has the transmission line structure isolated from the radiating structure.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative broadband antenna system allowing multiple antennas or other devices to be stacked collinearly, or disposed coaxially, in a single tubular structure, without interfering with the performance of the antenna system. As illustrated in the accompanying drawings and disclosed in the accompanying claims, the invention is a broadband antenna system comprising at least one modified conical radiating element having a radiating portion with a first circumference, a substantially cylindrical feed portion with a second circumference and that comprises at least one tapered feed point, and a first at least one operating structure connected to and operating the feed portion, wherein the at least one tapered feed point may be disposed substantially on the second circumference of the substantially cylindrical feed portion. The first at least one operating structure may further comprise a feed line, a coaxial cable, a transmission line, a twin lead, a stripline, and a microstrip. The at least one modified conical radiating element may be a modified monocone disposed on a ground plane or a modified bicone having a balun.

The broadband antenna system may further comprise at least one device collinear to or coaxial with the at least one modified conical radiating element; a second at least one operating structure, disposed within the at least one modified conical radiating element and connected to the at least one device; and the at least one device may be operated by the second at least one operating structure, without interfering with the performance of the at least one modified conical radiating element or other antenna elements. The second at least one operating structure may further comprise a feed line, a coaxial cable, a power cable, a digital cable, a fiber optic cable, a wire, piping, tubing, a mechanical actuator, a gas transfer system, a liquid transfer system, and a solid material transfer system.

As embodied herein, the at least one modified conical radiating element of the broadband antenna system may be a modified monocone disposed on a ground plane or a modified bicone having a balun. The at least one device may further comprise at least one modified bicone, and a plurality of the at least one modified bicone may be stacked collinearly, separated by a dielectric isolator therebetween each of the plurality of the modified bicone, and operated by a plurality of the second at least one operating structure.

The broadband antenna system of the present invention may further comprise a plurality of the at least one tapered feed point, and the distance between each of the plurality of the at least one tapered feed point around the circumference of the substantially cylindrical feed portion may be less than ½ wavelength of the highest frequency of operation.

In addition, the broadband antenna system of the present invention may further comprise at least one modified conical radiating element having a radiating portion, a feed portion comprising at least one tapered feed point, and a first at least one operating structure connected to and operating the feed portion, wherein the radiating portion is substantially cylindrical with a first circumference, the feed portion is substantially cylindrical with a second circumference coincident with the first circumference of the radiating portion, and wherein the at least one tapered feed point is disposed substantially on the second circumference of the feed portion. The first at least one operating structure may further comprises a feed line, a coaxial cable, a transmission line, a twin lead, a stripline, and a microstrip.

In this embodiment, the at least one modified conical radiating element may be a modified monocone disposed on a ground plane or a modified bicone having a balun. In additional embodiments, the balun of the bicone or bicones may be vertically disposed, horizontally disposed, or may be an integrated wraparound balun that is vertically disposed in the at least one modified bicone, and the at least one bicone may be formed by rolling a flexible microwave substrate material.

According to this embodiment, the broadband antenna system of the present invention may further comprise at least one device collinear to or coaxial with the at least one modified conical radiating element; a second at least one operating structure, disposed within the at least one modified conical radiating element and connected to the at least one device; and the at least one device may be operated by the second at least one operating structure, without interfering with the performance of the at least one modified conical radiating element or other antenna elements. The second at least one operating structure may further comprise a feed line, a coaxial cable, a transmission line, a twin lead, a stripline, and a microstrip, a power cable, a digital cable, a fiber optic cable, a wire, piping, tubing, a mechanical actuator, a gas transfer system, a liquid transfer system, and a solid material transfer system.

According to this embodiment, the at least one modified conical radiating element may be a modified monocone disposed on a ground plane or a modified bicone having a balun.

In the broadband antenna system according to this embodiment, the at least one device may further comprise at least one modified bicone, and a plurality of the at least one modified bicone may be stacked collinearly, separated by a dielectric isolator therebetween each of the plurality of the modified bicone, and operated by a plurality of the second at least one operating structure.

As disclosed herein, the at least one device may be a radiating antenna, another type of antenna element, a GPS system, a camera, an IR sensor, a light, an audio device, a radar device, and a communications system. In additional embodiments, the balun of the bicone or bicones may be vertically disposed, horizontally disposed, or may be an integrated wraparound balun that is vertically disposed in the at least one modified bicone, and the at least one bicone may be formed by rolling a flexible microwave substrate material.

In this embodiment, the broadband antenna system of the present invention may further comprise a plurality of the at least one tapered feed point, and the distance between each of the plurality of the at least one tapered feed point around the circumference of the substantially cylindrical feed portion may be less than ½ wavelength of the highest frequency of operation.

DETAILED DESCRIPTION OF THE INVENTION

Figure 2:
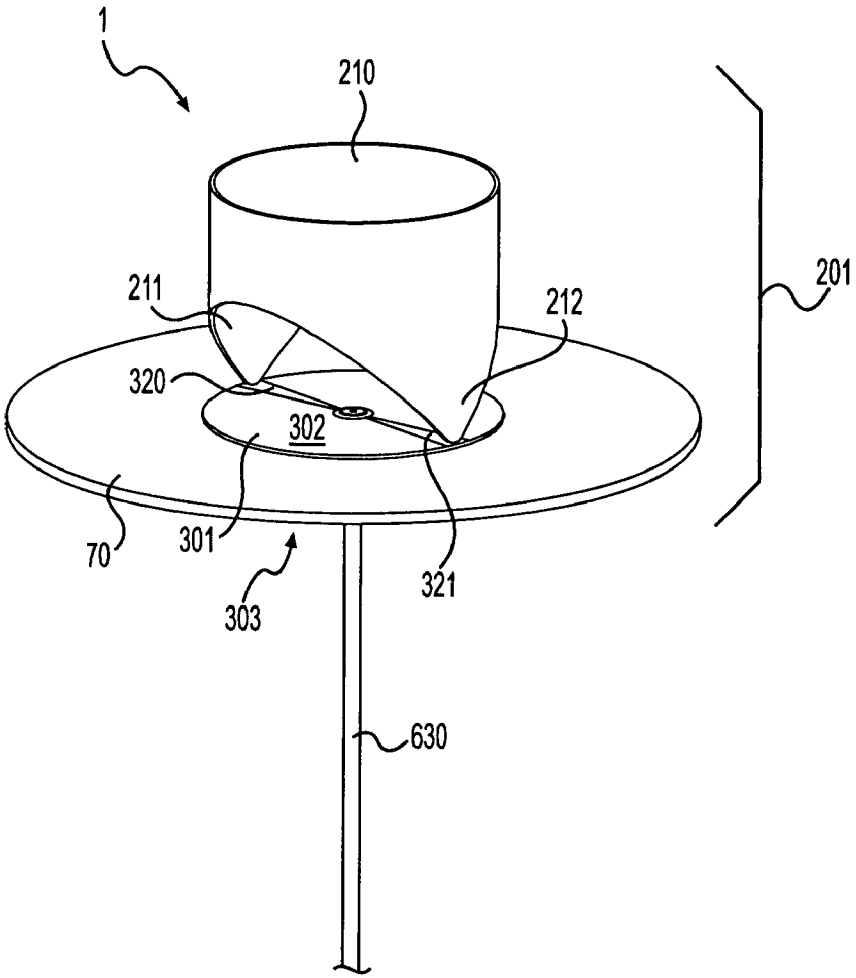
FIG. 2 is a perspective view of a modified monocone antenna system, having a coneless cylindrical dual feed element, disposed above a limited ground plane according to a first embodiment of the present invention.
Figure 1:
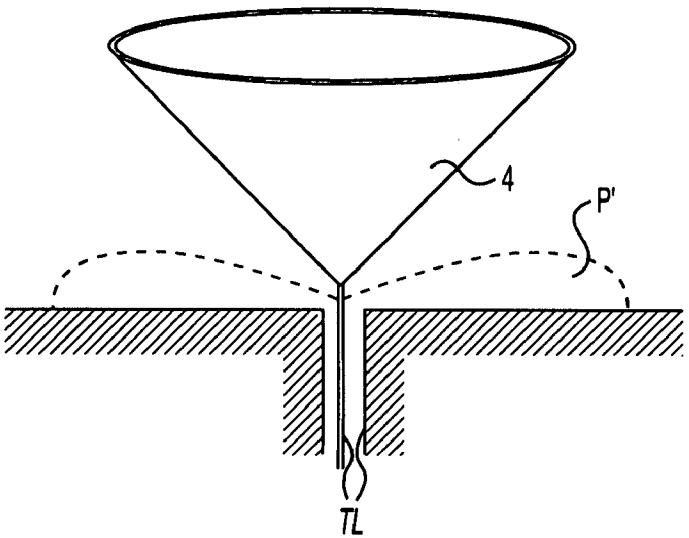
FIG. 1 PRIOR ART
FIG. 1 is a perspective view of a prior art monocone antenna disposed above a ground plane.

Referring to FIG. 1, a prior art monocone antenna disposed above a ground plane is shown. The prior art monocone exemplifies the conical shape, single conic tip and single feed found in the known art. In comparison, a "coneless monocone" according to a first embodiment of the present invention is shown in FIG. 2. Coneless monocone antenna system 1 of the present invention comprises modified "coneless" radiator 210, wherein the feed portion of the cone is cut away and the cone is modified to be substantially cylindrical, leaving "tapered feed points" 211 and 212 in place of the typical prior art conic tip. Although not shown, the monocone antenna system of the present invention also contemplates a design having a single tapered feed point in place of the typical prior art conic tip.

With continuing reference to FIG. 2, coneless monocone antenna system 1 of the present invention preferably comprises coneless monocone 201, having coneless radiator 210 disposed on limited ground plane 70, which further comprises microwave substrate 301. Microwave substrate 301 further comprises upper surface 302 and lower surface 303 (not visible in the perspective view). As embodied herein, coneless radiator 210 preferably is shaped to provide first tapered feed point 211 and second tapered feed point 212, which are electrically connected respectively with first feed side trace 320 and second feed side trace 321, on upper surface 302 of microwave substrate 301. Not visible in the perspective view is lower surface 303 of microwave substrate 301, which is a conductive metallic sheet. Coneless monocone 201 preferably is fed by coaxial cable 630. Coneless radiator 210 may be formed from any appropriate conductive material, preferably a metal such as aluminum, brass or copper tubing. Although coneless radiator 210 is disclosed herein as cylindrical in cross-section, the present invention contemplates that the modified cone may be elliptical, triangular, square, rectangular or even octagonal or other shape. The cylinder may be preferable for ease of manufacture, but need not exclude other shapes as noted. Microwave substrate 301 may be formed from appropriate dielectric and metal materials, such that the feed side traces may be formed through a photolithographic or other process. As shown in FIG. 2, the feed system for coneless monocone antenna system 1 is a coaxial cable, however, the present invention contemplates that other feed systems, such as transmission lines, twin lead, stripline, microstrip and other appropriate feeds, may be used, and fall within the scope of the invention.

Although not shown, an alternate embodiment of the present invention may be a coneless monocone antenna system having a coneless monocone as described above in connection with FIG. 2, but disposed on infinite ground plane.

Figure 4:
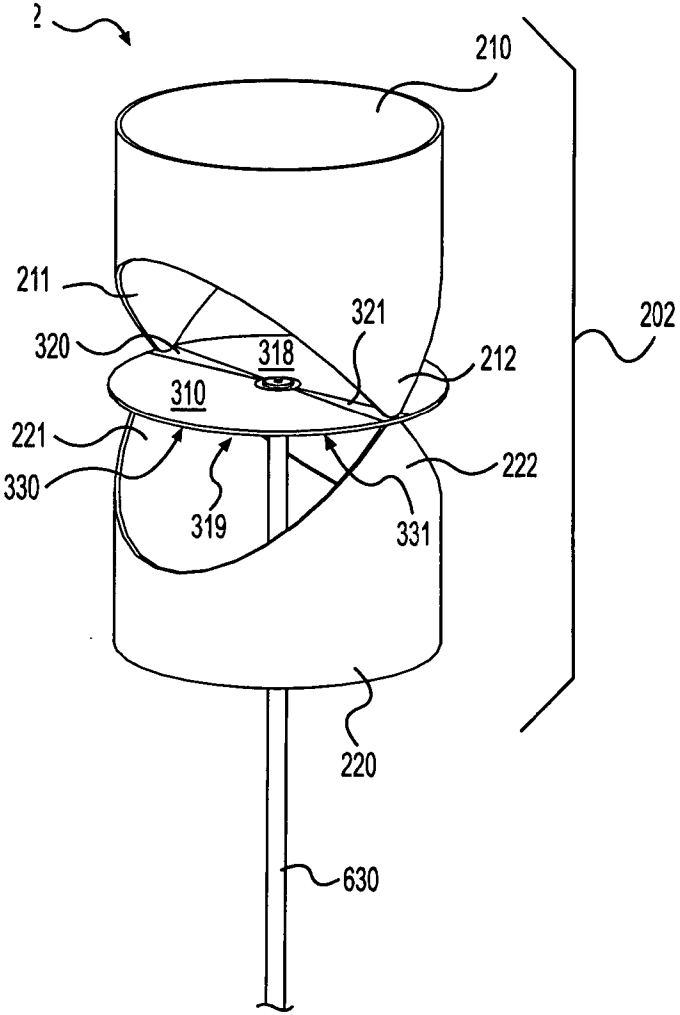
FIG. 4 is a perspective view of a modified biconical antenna system, having a coneless cylindrical dual feed upper element and a coneless cylindrical dual feed lower element, according to a second embodiment of the present invention.
Figure 3:
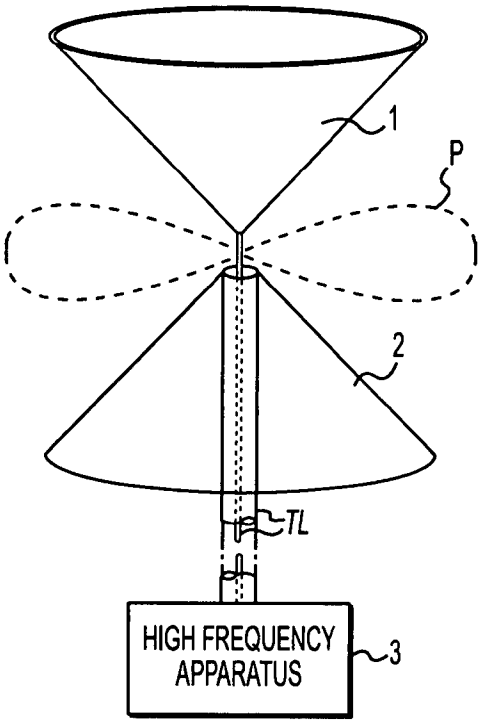
FIG. 3 PRIOR ART
FIG. 3 is a perspective view of a prior art biconical antenna.

Referring now to FIG. 3, a typical prior art biconical antenna is shown, comprising two conic tips and a single feed region. In comparison in FIG. 4, a "coneless biconical" antenna according to a second embodiment of the present invention is shown. Referring now to FIG. 4, coneless biconical antenna system 2 preferably comprises modified upper coneless radiator 210, wherein a portion of the conic region of the cone is cut away and the cone is modified to be substantially cylindrical, leaving two upper "tapered feed points" 211 and 212 in place of the known upper conic tip, and modified lower coneless radiator 220, having the same shaped or cutaway portion as upper coneless radiator 210, and leaving two lower "tapered feed points" 221 and 222 in place of the known lower conic tip.

With continuing reference to FIG. 4, coneless biconical antenna system 2 of the present invention preferably comprises coneless biconical 202, having upper coneless radiator 210 disposed on balun 310, which further comprises upper or feed side 318 and lower or ground side 319 (not visible in the perspective view). Upper coneless radiator 210 preferably is shaped to provide first upper tapered feed point 211 and second upper tapered feed point 212, which are electrically connected respectively with first feed side trace 320 and second feed side trace 321, on feed side 318 of balun 310. As embodied herein, coneless biconical 202 further comprises lower coneless radiator 220 disposed on ground side 319 of balun 310. Not visible in the perspective view are first ground side trace 330 and second ground side trace 331. Lower coneless radiator 220 preferably is shaped to provide first lower tapered feed point 221 and second lower tapered feed point 222, which are electrically connected respectively with first ground side trace 330 and second ground side trace 331, on ground side 319 of balun 310. Coneless biconical 202 preferably is fed by coaxial cable 630. Upper coneless radiator 210 and lower coneless radiator 220 may be formed from any appropriate conductive material, preferably a metal such as aluminum, brass or copper. Although upper coneless radiator 210 and lower coneless radiator 220 are disclosed herein as cylindrical in cross-section, the present invention contemplates that the modified cones may be elliptical, triangular, square, rectangular or even octagonal or other shape. The cylinder may be preferable for ease of manufacture, but need not exclude other shapes as noted. Balun 310 may be formed from appropriate dielectric and metal materials (for example, Duroid or other Teflon/fiberglass material), such that the feed side traces and ground side traces may be formed through a photolithographic or other process. As shown, the feed system for coneless biconical antenna system 2 is a coaxial cable, however, as described above in connection with coneless monocone antenna system 1, the present invention contemplates that other appropriate feed systems may be used, and fall within the scope of the invention.

Figure 5:
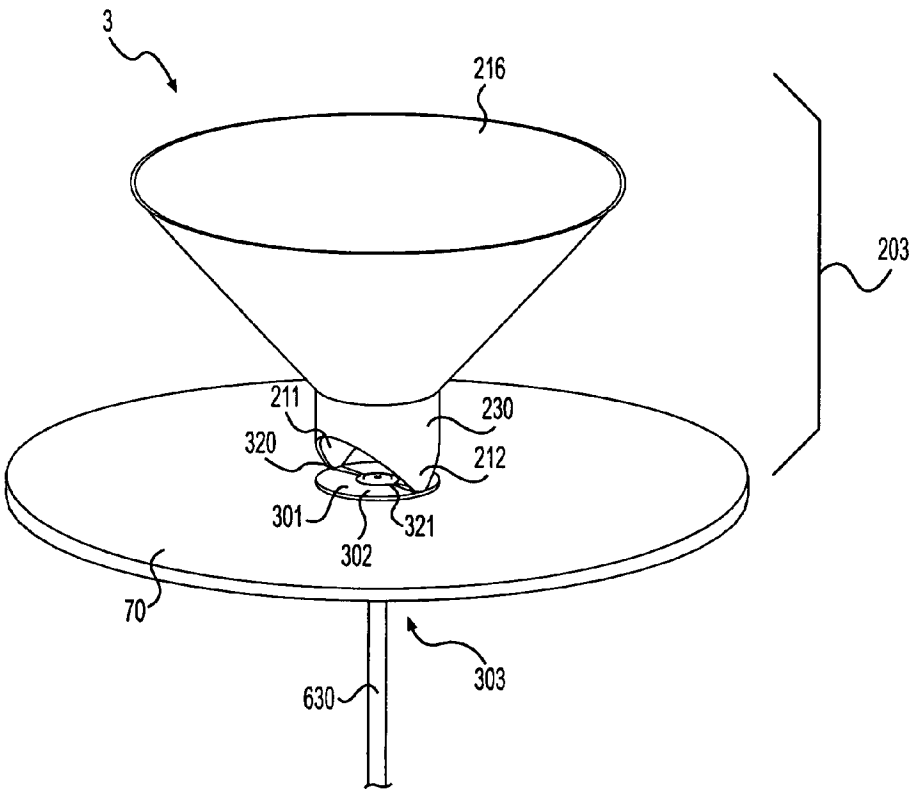
FIG. 5 is a perspective view of a modified monocone antenna system, having a frustum radiating portion disposed on coneless cylindrical feed portion, disposed above a limited ground plane according to a third embodiment of the present invention.

Referring now to FIG. 5, frustum monocone antenna system 3 of the present invention preferably comprises frustum monocone 203, having frustum radiator 216 disposed on coneless feed portion 230. This configuration represents an intermediate design of the present invention, as it comprises both the traditional conically-shaped radiator, and novel cylindrical "coneless" feed portion of the present invention. Frustum monocone 203 preferably is disposed on limited ground plane 70, which further comprises microwave substrate 301. Microwave substrate 301 further comprises upper surface 302 and lower surface 303 (not visible in the perspective view). As embodied herein, coneless feed portion 230 preferably is shaped to provide first tapered feed point 211 and second tapered feed point 212, which are electrically connected respectively with first feed side trace 320 and second feed side trace 321, on upper surface 302 of microwave substrate 301. Not visible in the perspective view is lower surface 303 of microwave substrate 301, which is a conductive metallic sheet. Frustum monocone 203 preferably is fed by coaxial cable 630. Frustum radiator 216 and coneless feed portion 230 may be formed from any appropriate conductive material, preferably a metal such as aluminum, brass or copper. Microwave substrate 301 may be formed from appropriate dielectric and metal materials, such that the feed side traces may be formed through a photolithographic or other process. As shown in FIG. 5, the feed system for frustum monocone antenna system 3 is a coaxial cable, however, as described above in connection with coneless monocone antenna system 1, the present invention contemplates that other appropriate feed systems may be used, and fall within the scope of the invention.

Although not shown, an alternate embodiment of the present invention may be a frustum monocone antenna system having a frustum monocone as described above in connection with FIG. 5, but disposed on infinite ground plane.

Figure 6:
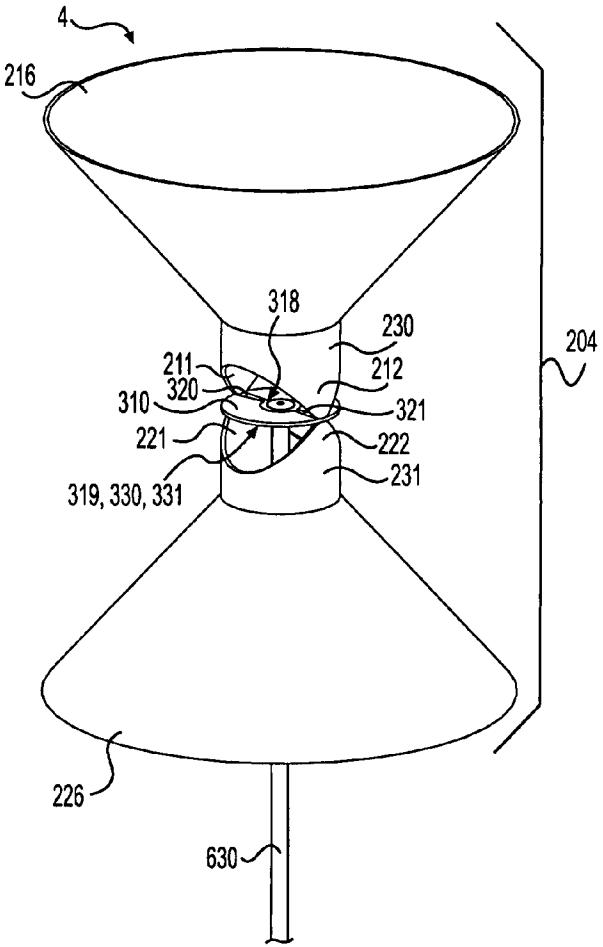
FIG. 6 is a perspective view of a modified biconical antenna system having an upper frustum radiating portion disposed on an upper coneless cylindrical feed portion and a lower frustum radiating portion disposed on a lower coneless cylindrical feed portion, according to a fourth embodiment of the present invention.

Referring now to FIG. 6, frustum biconical antenna system 4 of the present invention is shown. This configuration, like the frustum monocone of FIG. 5, represents an intermediate design of the present invention, as it comprises both the traditional conically-shaped radiator and the novel cylindrical "coneless" feed portion of the present invention. Frustum biconical antenna system 4 preferably comprises frustum biconical 204, having upper frustum radiator 216 disposed on upper coneless cylindrical feed portion 230, and thereupon on balun 310, which further comprises upper or feed side 318 and lower or ground side 319 (not visible in the perspective view). Upper coneless cylindrical feed portion 230 preferably is shaped to provide first upper tapered feed point 211 and second upper tapered feed point 212, which are electrically connected respectively with first feed side trace 320 and second feed side trace 321, on feed side 318 of balun 310. As embodied herein, frustum biconical 204 further comprises lower frustum radiator 226 disposed on lower coneless cylindrical feed portion 231, and thereupon on ground side 319 of balun 310. Not visible in the perspective view are first ground side trace 330 and second ground side trace 331. Lower coneless cylindrical feed portion 231 preferably is shaped to provide first lower tapered feed point 221 and second lower tapered feed point 222, which are electrically connected respectively with first ground side trace 330 and second ground side trace 331, on ground side 319 of balun 310. Frustum biconical 204 preferably is fed by coaxial cable 630. Upper frustum radiator 216, upper coneless cylindrical feed portion 230, lower frustum radiator 220 and lower coneless cylindrical feed portion 231 may be formed from any appropriate conductive material, preferably a metal such as aluminum, brass or copper tubing. Balun 310 may be formed from appropriate dielectric and metal materials (for example, Duroid or other Teflon/fiberglass material), such that the feed side traces and ground side traces may be formed through a photolithographic or other process. As shown, the feed system for frustum biconical antenna system 4 is a coaxial cable, however, as described above in connection with coneless monocone antenna system 1, the present invention contemplates that other appropriate feed systems may be used, and fall within the scope of the invention.

Figure 7:
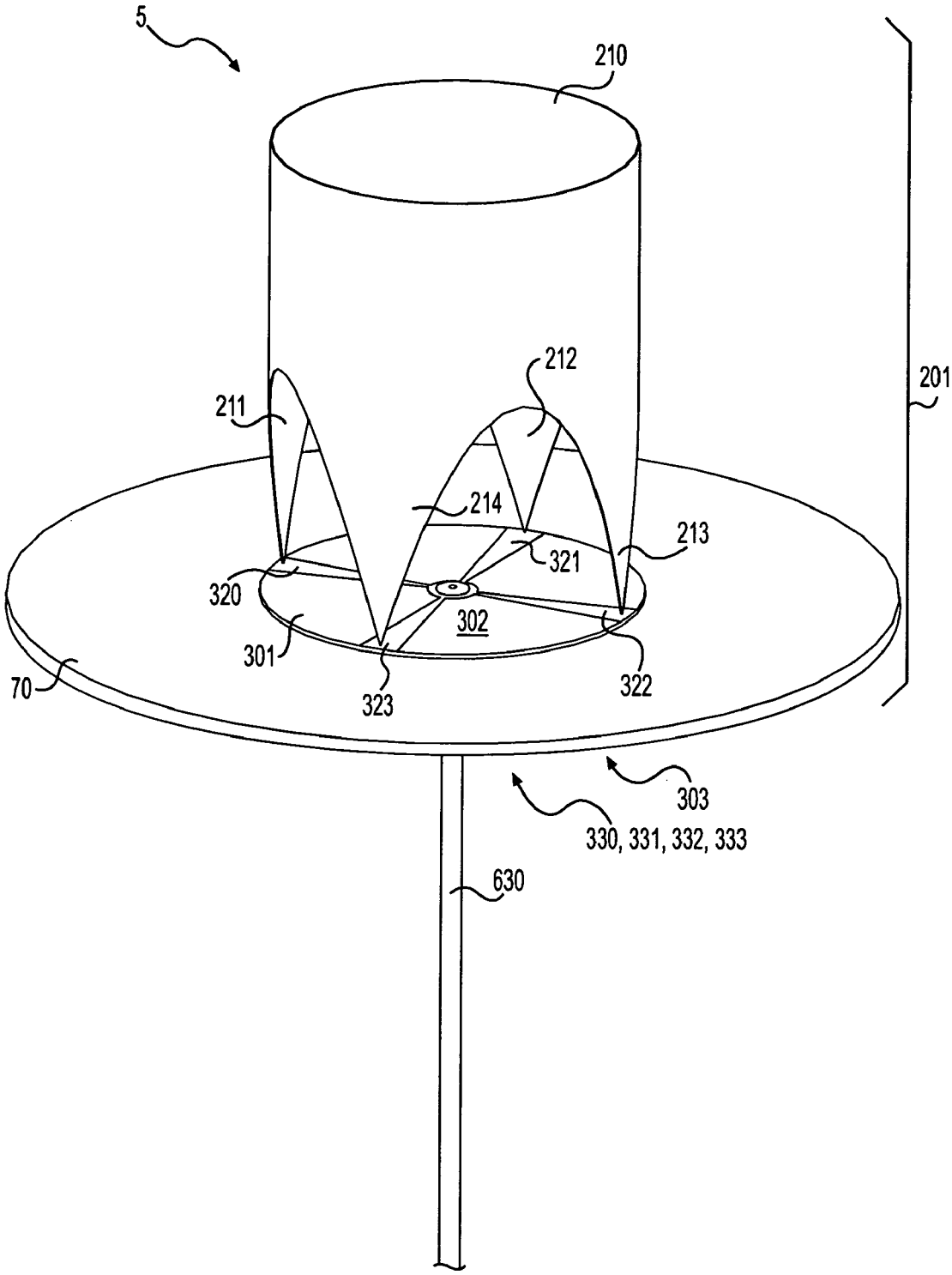
FIG. 7 is a perspective view of a modified monocone antenna system, having a coneless cylindrical element with four feed points, disposed above a limited ground plane according to a fifth embodiment of the present invention.

Referring now to FIG. 7, a fifth embodiment of the present invention is shown as coneless monocone antenna system 5. Coneless monocone antenna system 5 preferably comprises coneless monocone 201, having coneless radiator 210 disposed on limited ground plane 70, which further comprises microwave substrate 301. Microwave substrate 301 further comprises upper surface 302 and lower surface 303 (not visible in the perspective view). As embodied herein, coneless radiator 210 preferably is shaped to provide first tapered feed point 211, second tapered feed point 212, third tapered feed point 213, and fourth tapered feed point 214, which are electrically connected respectively with first feed side trace 320, second feed side trace 321, third feed side trace 322, and fourth feed side trace 323 on upper surface 302 of microwave substrate 301.

As embodied herein, the highest frequency of operation of the present invention may be determined by the number of feed points, the spacing between the feed points, and the diameter of the coneless feed region. This is expressed as $$f_H = \frac{nc}{2\pi D},$$

where $f_H$=highest frequency of operation, n=number of feed points, c=speed of light, and D=diameter of feed region. Thus, the spacing between feed points should be at least/1;2λ of the highest desired frequency. Although not shown, the present invention contemplates that a plurality of feeds points, including but not limited to 3, 5, 6, 7, 8 or more, falls within the scope of the invention.

With continuing reference to FIG. 7, coneless monocone 201 preferably is fed by coaxial cable 630. Coneless radiator 210 may be formed from any appropriate conductive material, preferably a metal such as aluminum, brass or copper tubing. Although coneless radiator 210 is disclosed herein as cylindrical in cross-section, the present invention contemplates that the modified cone may be elliptical, triangular, square, rectangular or even octagonal or other shape. The cylinder may be preferable for ease of manufacture, but need not exclude other shapes as noted. As shown, the feed system for coneless monocone antenna system 5 is a coaxial cable, however, as described above in connection with coneless monocone antenna system 1, the present invention contemplates that other appropriate feed systems may be used, and fall within the scope of the invention.

Figure 8:
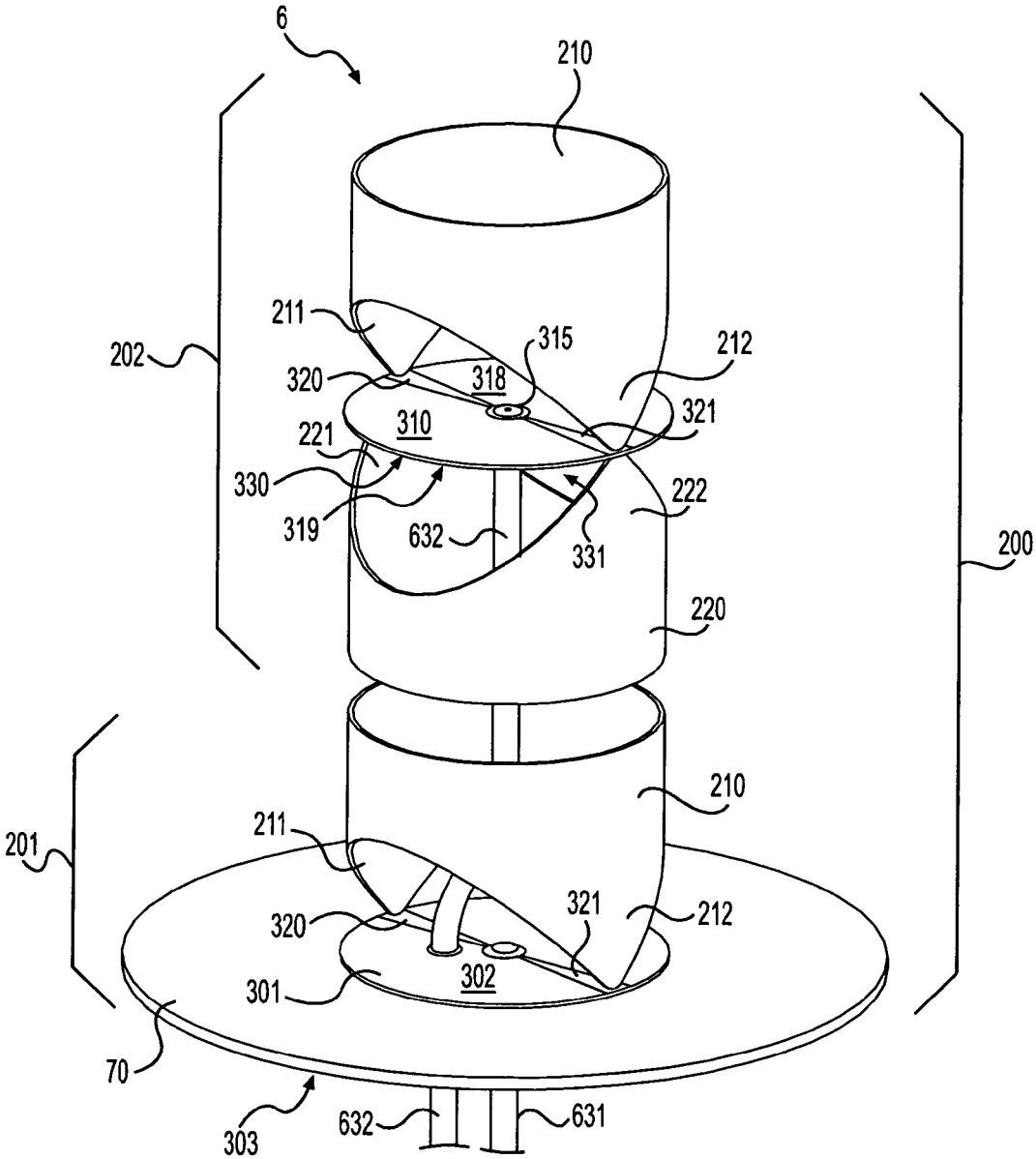
FIG. 8 is a perspective view of a stacked collinear antenna system combining a modified monocone and a modified bicone, both having coneless cylindrical dual feed elements, disposed on a ground plane according to a sixth embodiment of the present invention.

Referring now to FIG. 8, a sixth embodiment of the present invention is shown as stacked coneless monocone and biconical antenna system 6. Stacked coneless monocone and biconical antenna system 6 preferably comprises coneless sub-assembly 200, which further comprised coneless monocone 201 and stacked thereupon, coneless biconical 202. Coneless monocone 201 preferably further comprises coneless radiator 210 disposed on limited ground plane 70, which further comprises microwave substrate 301. Microwave substrate 301 further comprises upper surface 302 and lower surface 303 (not visible in the perspective view). As embodied herein, coneless radiator 210 preferably is shaped to provide first tapered feed point 211 and second tapered feed point 212, which are electrically connected respectively with first feed side trace 320 and second feed side trace 321, on upper surface 302 of microwave substrate 301. Not visible in the perspective view is lower surface 303 of microwave substrate 301, which is a conductive metallic sheet. Coneless monocone 201 preferably is fed by first feed line 631.

Figure 9:
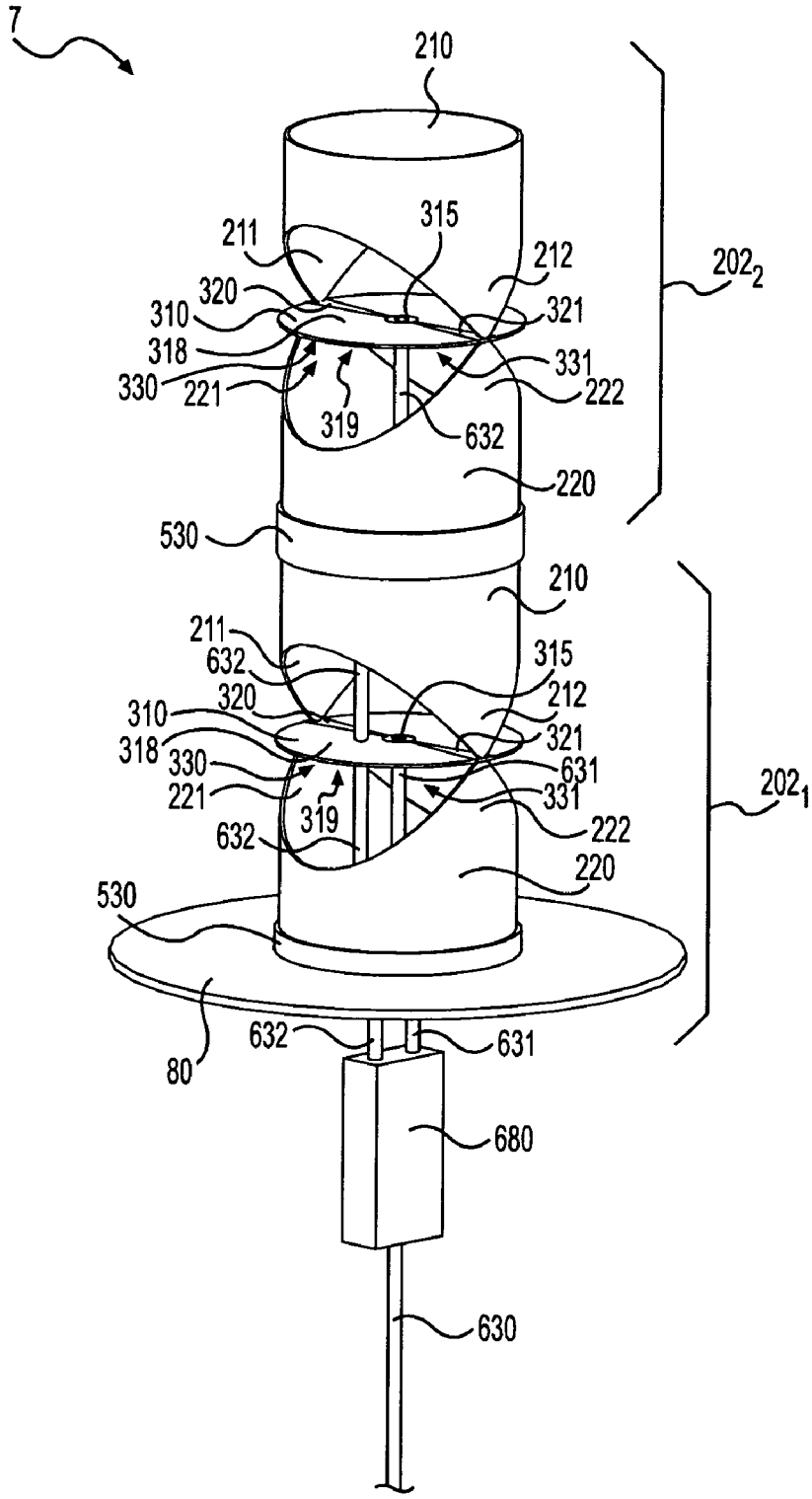
FIG. 9 is a perspective view of a stacked collinear double modified biconical antenna system having coneless cylindrical dual feed elements and a power combiner, disposed on a ground plane according to a seventh embodiment of the present invention.
Figure 10:
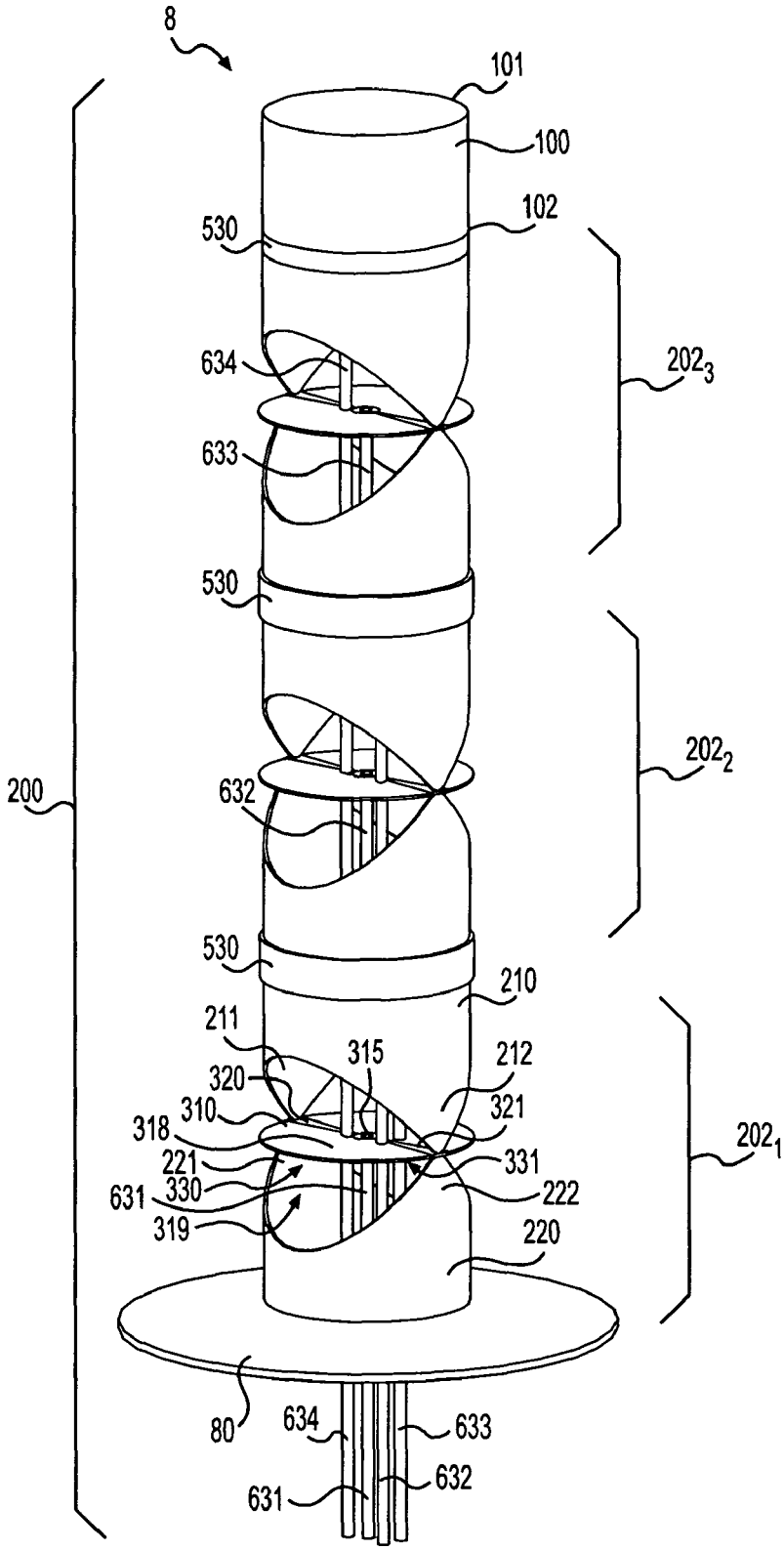
FIG. 10 is a perspective view of a stacked collinear triple modified biconical antenna system having coneless cylindrical dual feed elements and a collinear generic element stacked on the upper biconical element, disposed on a limited ground plane according to a eighth embodiment of the present invention.

With continuing reference to FIG. 8, coneless biconical 202 of stacked coneless monocone and biconical antenna system 6 preferably is stacked on coneless monocone 201 and may be separated by a dielectric gap, such as air (as shown), or by a solid dielectric isolator as shown in FIGS. 9 and 10. Coneless biconical 202 preferably further comprises upper coneless radiator 210 disposed on balun 310, which further comprises upper or feed side 318 and lower or ground side 319 (not visible in the perspective view). Upper coneless radiator 210 preferably is shaped to provide first upper tapered feed point 211 and second upper tapered feed point 212, which are electrically connected respectively with first feed side trace 320 and second feed side trace 321, on feed side 318 of balun 310. As embodied herein, coneless biconical 202 further comprises lower coneless radiator 220 disposed on ground side 319 of balun 310. Not visible in the perspective view are first ground side trace 330 and second ground side trace 331. Lower coneless radiator 220 preferably is shaped to provide first lower tapered feed point 221 and second lower tapered feed point 222, which are electrically connected respectively with first ground side trace 330 and second ground side trace 331, on ground side 319 of balun 310. Coneless biconical 202 preferably is fed by second feed line 632. which passes through the center of coneless monocone 201. Materials for and configuration of coneless monocone 201 and coneless biconical 202, are as described above for coneless monocone antenna system 1 and coneless biconical antenna system 2. As shown, the feed system for stacked coneless monocone and biconical antenna system 6 is two coaxial cables (feed lines 631 and 632), however, as described above in connection with coneless monocone antenna system 1 and coneless biconical antenna system 2, the present invention contemplates that other appropriate feed systems may be used, and fall within the scope of the invention.

Referring now to FIG. 9, a seventh embodiment of the present invention is shown as stacked coneless biconical antenna system 7 having two coneless biconical antennas stacked in a collinear array. Coneless biconical antenna system 7 of the present invention preferably comprises first coneless biconical $\mathbf{202}_1$, disposed on substrate 80. First coneless biconical $\mathbf{202}_1$ may be separated from substrate 80 by dielectric isolator 530, as shown, or may be attached directly to substrate 80, depending on the nature of the installation. First coneless biconical $\mathbf{202}_1$ preferably comprises upper coneless radiator 210 disposed on balun 310, which further comprises upper or feed side 318 and lower or ground side 319 (not visible in the perspective view). Upper coneless radiator 210 preferably is shaped to provide first upper tapered feed point 211 and second upper tapered feed point 212, which are electrically connected respectively with first feed side trace 320 and second feed side trace 321, on feed side 318 of balun 310. Coneless biconical $\mathbf{202}_1$ further comprises lower coneless radiator 220 disposed on ground side 319 of balun 310. Not visible in the perspective view are first ground side trace 330 and second ground side trace 331. Lower coneless radiator 220 preferably is shaped to provide first lower tapered feed point 221 and second lower tapered feed point 222, which are electrically connected respectively with first ground side trace 330 and second ground side trace 331, on ground side 319 of balun 310. In this collinear stacked configuration, coneless biconical antenna system 7 further comprises a second coneless biconical $\mathbf{202}_2$, substantially the same as first coneless biconical $\mathbf{202}_1$ as described above, and stacked collinearly on top of first coneless biconical $\mathbf{202}_1$. Second coneless biconical $\mathbf{202}_2$ preferably is separated from first coneless biconical $\mathbf{202}_1$ by dielectric isolator 530. As embodied herein, stacked coneless biconical antenna system 7 preferably is fed by coaxial cable 630, which may be routed through power divider 680, as shown, or may be fed directly into first coneless biconical $\mathbf{202}_1$. As shown herein with power divider 680, first coneless biconical $\mathbf{202}_1$ is fed by first feed line 631 (as embodied herein, a coaxial cable), that runs to central balun hole 315 of first coneless biconical $\mathbf{202}_1$. Second coneless biconical $\mathbf{202}_2$ is fed independently by second feed line 632 (as embodied herein, again a coaxial cable). Second feed line 632 preferably is run through the hollow center of first coneless biconical $\mathbf{202}_1$, through balun 310 of first coneless biconical $\mathbf{202}_1$, through hollow center of coneless radiator 220 of second coneless biconical $\mathbf{202}_2$, to central balun hole 315 of second coneless biconical $\mathbf{202}_2$. Both coneless biconicals, $\mathbf{202}_1$ and $\mathbf{202}_2$, are fed at their respective upper tapered feed points (211 and 212) and lower tapered feed points (220 and 221) by their respective feed lines (631 and 632), which connect electrically at their respective central balun holes 315, to their respective feed side traces (320 and 321), and ground side traces (330 and 331). Materials for and configuration of coneless biconicals, as well as variations for feed system, for stacked coneless biconical antenna system 7 are as described above for coneless biconical antenna system 2.

Referring now to FIG. 10, an eighth embodiment of the present invention is shown as stacked coneless biconical antenna system with stacked device 8 having three coneless biconical antennas and one or more additional devices stacked in a collinear array. Coneless biconical antenna system with stacked device 8 of the present invention preferably comprises first coneless biconical $\mathbf{202}_1$, disposed on substrate 80. First coneless biconical $\mathbf{202}_1$ may be attached directly to substrate 80 as shown, or may be separated from substrate 80 by a dielectric isolator 530 (not shown), depending on the nature of the installation. First coneless biconical $\mathbf{202}_1$ preferably comprises upper coneless radiator 210 disposed on balun 310, which further comprises upper or feed side 318 and lower or ground side 319 (not visible in the perspective view). Upper coneless radiator 210 preferably is shaped to provide first upper tapered feed point 211 and second upper tapered feed point 212, which are electrically connected respectively with first feed side trace 320 and second feed side trace 321, on feed side 318 of balun 310. Coneless biconical $\mathbf{202}_1$ further comprises lower coneless radiator 220 disposed on ground side 319 of balun 310. Not visible in the perspective view are first ground side trace 330 and second ground side trace 331. Lower coneless radiator 220 preferably is shaped to provide first lower tapered feed point 221 and second lower tapered feed point 222, which are electrically connected respectively with first ground side trace 330 and second ground side trace 331, on ground side 319 of balun 310. In this collinear stacked configuration, coneless biconical antenna system with stacked device 8 further comprises a second coneless biconical $\mathbf{202}_2$, substantially the same as first coneless biconical $\mathbf{202}_1$ as described above, and stacked collinearly on top of first coneless biconical $\mathbf{202}_1$, and a third coneless biconical $\mathbf{202}_3$, also substantially the same as first coneless biconical $\mathbf{202}_1$ as described above, and stacked collinearly on top of second coneless biconical $\mathbf{202}_2$. Second coneless biconical $\mathbf{202}_2$ preferably is separated from first coneless biconical $\mathbf{202}_1$ by dielectric isolator 530. As well, third coneless biconical $\mathbf{202}_3$ preferably is separated from second coneless biconical $\mathbf{202}_2$ by dielectric isolator 530.

With continuing reference to FIG. 10, as embodied herein, stacked coneless biconical antenna system with stacked device 8 further comprises stacked generic device 100. Device 100 may be another antenna element, such as a SATCOM or GPS antenna; a camera, IR sensor, light, audio device such as a siren; an electrical or mechanical device operated by a hydraulic, pneumatic or mechanical control, or by a gas, liquid or solid material transfer system; or other device as desired. The present invention also contemplates that device 100 may be a combination of multiple devices as described herein.

With continuing reference to FIG. 10, as embodied herein, stacked coneless biconical antenna system with stacked device 8 preferably is fed by a plurality of coaxial cables: first feed line 631, which preferably is fed directly into first coneless biconical $\mathbf{202}_1$ to central balun hole 315 of first coneless biconical $\mathbf{202}_1$; second feed line 632, which preferably is run through the hollow center of first coneless biconical $\mathbf{202}_1$, through balun 310 of first coneless biconical $\mathbf{202}_1$, through hollow center of the lower coneless radiator of second coneless biconical $\mathbf{202}_2$, and to central balun hole 315 of second coneless biconical $\mathbf{202}_2$; third feed line 633, which preferably is run through the hollow center of first coneless biconical $\mathbf{202}_1$ and second coneless biconical $\mathbf{202}_2$, through balun 310 of first coneless biconical $\mathbf{202}_1$ and balun 310 of second coneless biconical $\mathbf{202}_2$, through hollow center of the lower coneless radiator of third coneless biconical $\mathbf{202}_3$, and to central balun hole 315 of third coneless biconical $\mathbf{202}_3$; and fourth feed line 634, which preferably is run through the hollow center of first coneless biconical $\mathbf{202}_1$, second coneless biconical $\mathbf{202}_2$, and third coneless biconical $\mathbf{202}_3$, through the three baluns 310 of first coneless biconical $\mathbf{202}_1$, second coneless biconical $\mathbf{202}_2$, and third coneless biconical $\mathbf{202}_3$, and to device or devices 100. As embodied herein, fourth feed line 634 may be a coaxial cable as shown, or may also be one or more power cables; one or more digital transmission lines (for example, fiber optic, Ethernet, USB, RS485 or other digital cable); one or more hydraulic, pneumatic or mechanical control; one or more gas, liquid or solid material transfer system; or other feed as desired. Each coneless biconical, $\mathbf{202}_1$, $\mathbf{202}_2$, and $\mathbf{202}_3$, is fed at its respective upper tapered feed points (211 and 212) and lower tapered feed points (220 and 221) by its respective feed lines (631, 632, and 633), which connect electrically at its respective central balun hole 315, to its respective feed side traces (320 and 321), and ground side traces (330 and 331). Materials for and configuration of the coneless biconicals, as well as other variations for the feed system of coneless biconical antenna system with stacked device 8 are as described above for coneless biconical antenna system 2 and are consider to fall within the scope of the present invention.

Figure 11D:
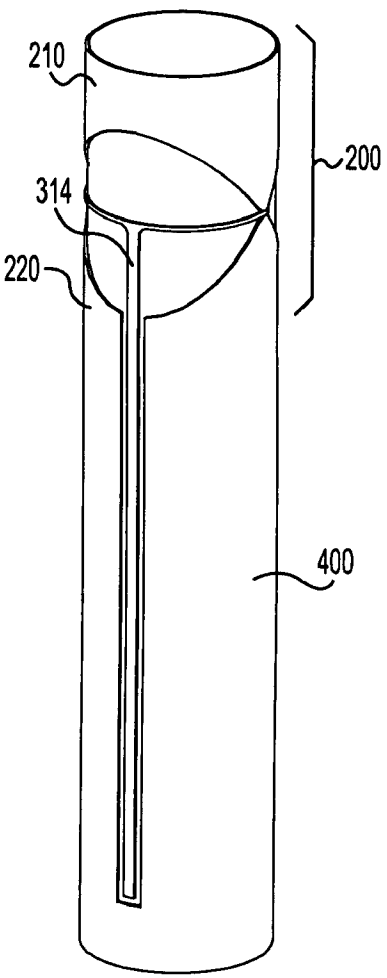
FIG. 11*d* is a perspective view of a modified biconical dipole element with coneless cylindrical dual feed elements and an integrated wraparound balun, according to an embodiment of the present invention.
Figure 11C:
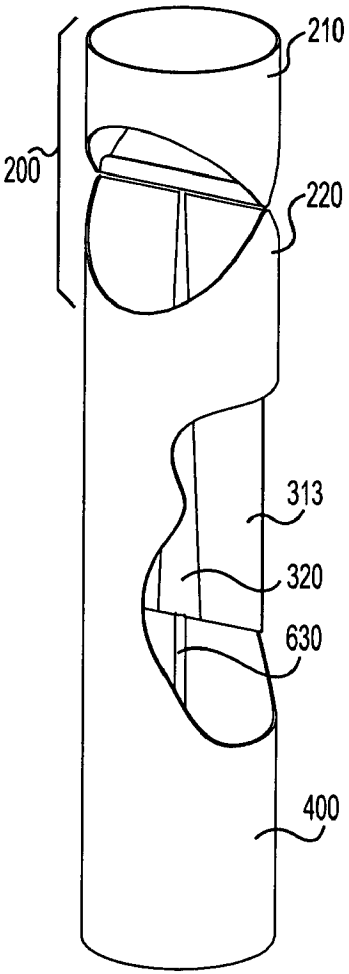
FIG. 11*c* is a perspective view with cut-away of a modified biconical dipole element with coneless cylindrical dual feed elements and a vertically-disposed balun, according to an embodiment of the present invention.
Figure 11B:
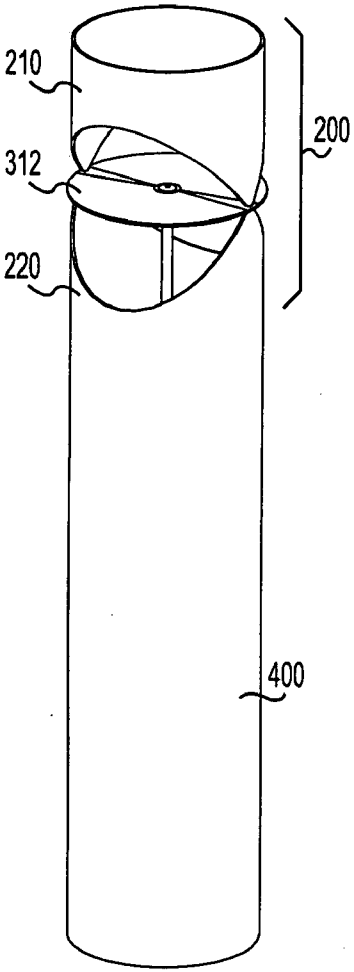
FIG. 11*b* is a perspective view of a modified biconical dipole element with coneless cylindrical dual feed elements and a horizontally-disposed balun, according to an embodiment of the present invention.
Figure 11A:
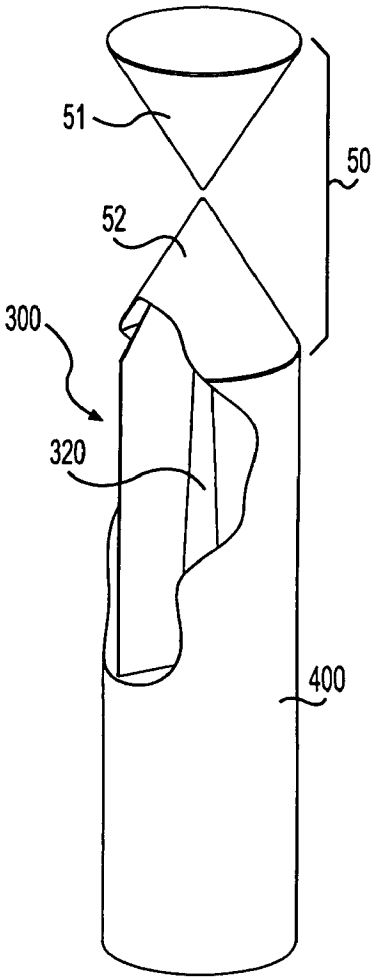
FIG. 11*a* is a sectional view with cut-away of a biconical dipole element disposed in a cylinder, showing a vertically-disposed balun, as disclosed in Applicant's prior U.S. Pat. No. 7,339,542.

Referring now to FIGS. 11*a-d*, variations on the balun of the present invention are shown. FIG. 11*a* shows a biconical dipole element 50 disposed in cylinder 400, having vertically-disposed balun 300 with feed side trace 320 (the ground side trace is not visible in this view), as disclosed in Applicant's prior U.S. Pat. No. 7,339,542. Biconical dipole element 50 further comprises upper cone 51 and lower cone 52. This design, while providing a useful ultra-broadband performance, was subject to coupling and interference when Applicant altered the design to stack another antenna element at the top of the tubular structure. In running an additional feed line through the conic tips of biconical dipole element 50, the proximity of the original feed braid to the additional feed line—constrained in the narrow openings in the conic tips of upper cone 51 and lower cone 52.—caused unwanted coupling. This led Applicant to design the present invention as a solution to the narrow opening in the conic tip region.

Referring now to FIG. 11*b*, a biconical dipole element having coneless sub-assembly 200 disposed in cylinder 400, according to another embodiment of the present invention, is shown. Coneless sub-assembly 200 further comprises upper coneless radiator 210 and lower coneless radiator 220, as described earlier in connection with coneless biconical antenna system 2 of the present invention. Upper coneless radiator 210 and lower coneless radiator 220 are disposed on either side of horizontally-oriented, circular balun 312, and in this configuration (as described earlier in connection with coneless biconical antenna system 2), coneless sub-assembly 200 may be incorporated into an improved version of Applicant's Ultra-Broadband antenna system, U.S. Pat. No. 7,339,542. As described above, a plurality of feed line, cables, piping or other controls or actuators, may be run through the center of cylinder 400 to feed, power or control upper elements, without causing coupling.

Referring now to FIG. 11*c*, a biconical dipole element having coneless sub-assembly 200 disposed in cylinder 400, according to another embodiment of the present invention, is shown. Coneless sub-assembly 200 further comprises upper coneless radiator 210 and lower coneless radiator 220, as described earlier in connection with coneless biconical antenna system 2 of the present invention. Upper coneless radiator 210 and lower coneless radiator 220 are disposed on either side of vertically-oriented, rectangular-shaped balun 313, which represents an intermediate design between the baluns shown in FIG. 11*a* and FIG. 11*b*. Balun 313 further comprises feed side trace 320 (the ground side trace is not visible in this view) and is fed by coaxial cable 630, which, by virtue of the coneless design of the present invention, may be routed through cylinder 400 and lower coneless radiator 220, without causing interference to the antenna system.

Referring now to FIG. 11*d*, a biconical dipole element having coneless sub-assembly 200 disposed in cylinder 400, according to another embodiment of the present invention, is shown. In this embodiment, cylinder 400 preferably is formed from a flexible microwave substrate that can be rolled into a cylindrical shape. Coneless sub-assembly 200 further comprises upper coneless radiator 210 and lower coneless radiator 220, as described earlier in connection with coneless biconical antenna system 2 of the present invention. In this embodiment, rectangular balun 313 and horizontal, circular balun 312 are replaced by integrated wraparound balun 314. Integrated wraparound balun 314 preferably is formed from Duroid, G10 or any appropriate, microwave substrate with copper or other metal cladding that can be etched, and may be positioned along the center axis of cylinder 400 and fed at the tips of the etched features of the G10 board.

As embodied herein, the foregoing balun configurations of FIGS. 11*b-d* may be incorporated into a broadband antenna system having one or more coneless elements along with multiple stacked collinear or coaxial antenna elements or other devices, all within the scope of the present invention.

Referring now to FIGS. 12-20, azimuth and elevation radiation patterns are shown that support Applicant's assertion that the innovative "coneless" design of the present invention provides comparable or even superior performance to the typical known "conical" monocone and bicone antenna systems.

Figure 12A:
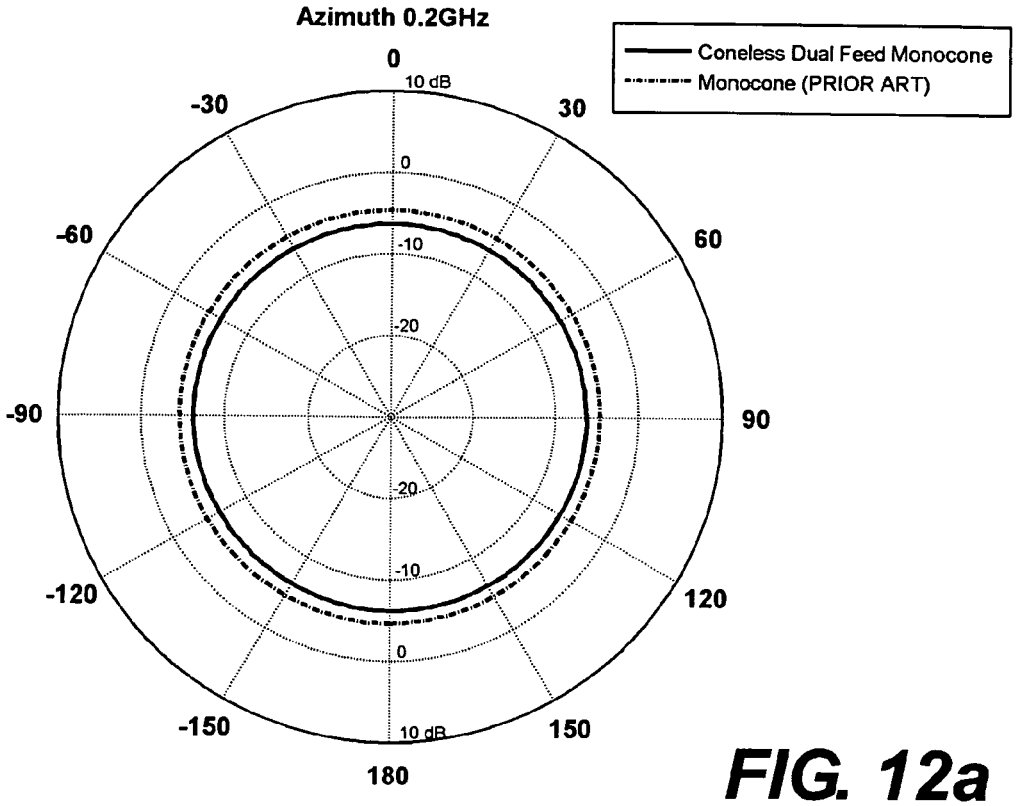
FIG. 12*a* depicts a graph, at 0.2 GHz, comparing the azimuth radiation patterns of a prior art monocone antenna with a modified monocone antenna system having a coneless cylindrical dual feed element according to a first embodiment of the present invention.
Figure 12B:
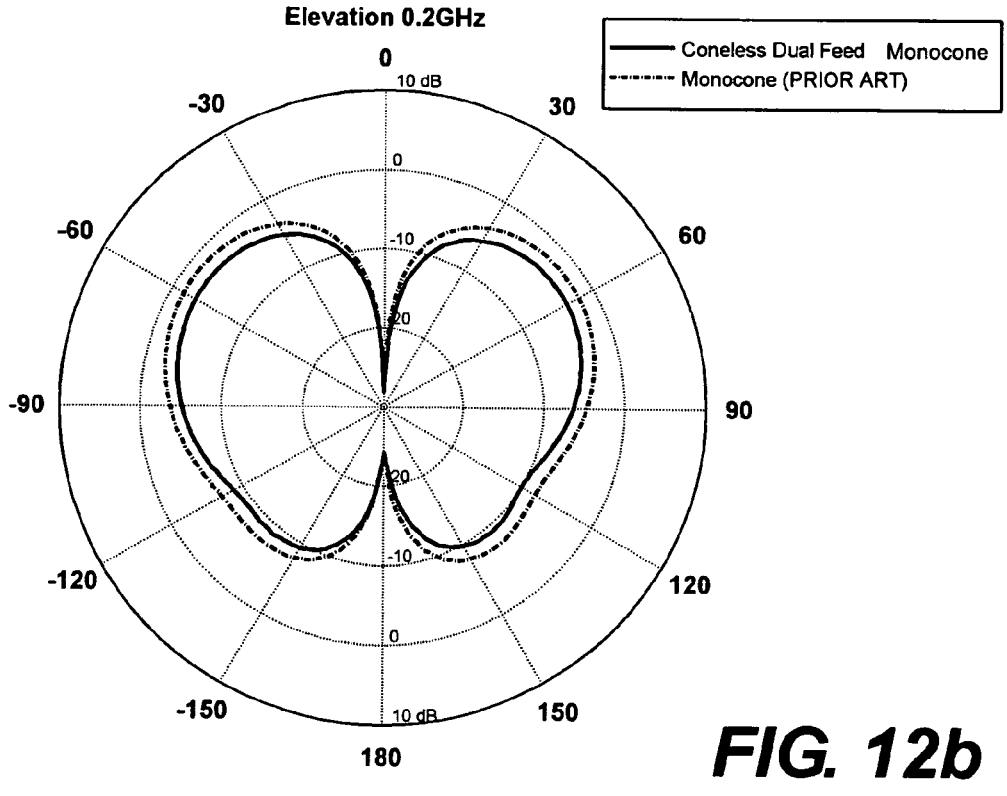
FIG. 12*b* depicts a graph, at 0.2 GHz, comparing the elevation radiation patterns of a prior art monocone antenna with a modified monocone antenna system having a coneless cylindrical dual feed element according to a first embodiment of the present invention.

Referring now to FIGS. 12*a* and 12*b*, two graphs depict the azimuth and elevation radiation patterns, respectively, of a preferred embodiment of coneless monocone antenna system 1, having a coneless cylindrical dual feed element, and a typical prior art monocone antenna at 0.2 GHz, showing that the pattern shape and gain are nearly identical.

Figure 13A:
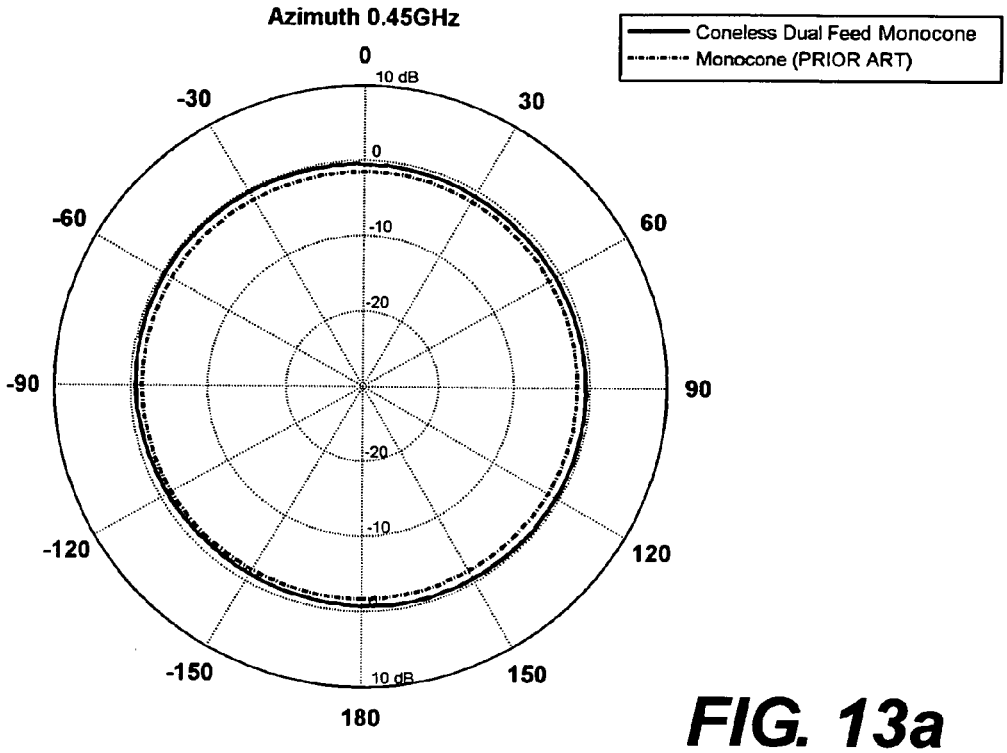
FIG. 13*a* depicts a graph, at 0.45 GHz, comparing the azimuth radiation patterns of a prior art monocone antenna with a modified monocone antenna system having a coneless cylindrical dual feed element according to a first embodiment of the present invention.
Figure 13B:
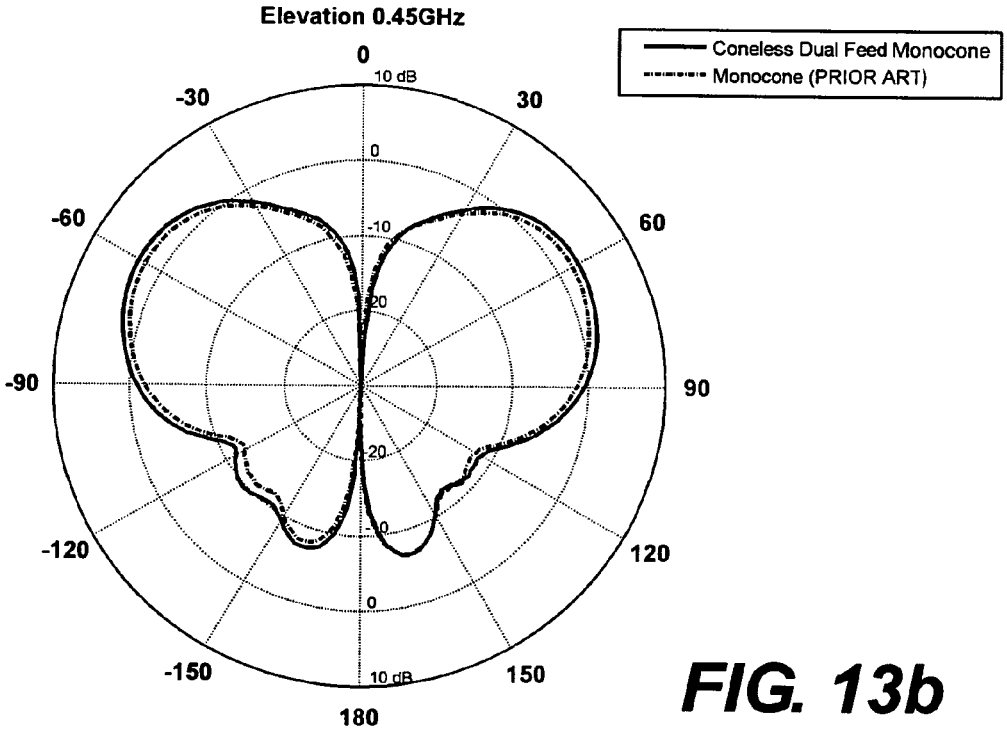
FIG. 13*b* depicts a graph, at 0.45 GHz, comparing the elevation radiation patterns of a prior art monocone antenna with a modified monocone antenna system having a coneless cylindrical dual feed element according to a first embodiment of the present invention.

Referring now to FIGS. 13*a* and 13*b*, two graphs depict the azimuth and elevation radiation patterns, respectively, of a preferred embodiment of coneless monocone antenna system 1, having a coneless cylindrical dual feed element, and a typical prior art monocone antenna at 0.45 GHz, showing that the pattern shape and gain are nearly identical.

Figure 14A:
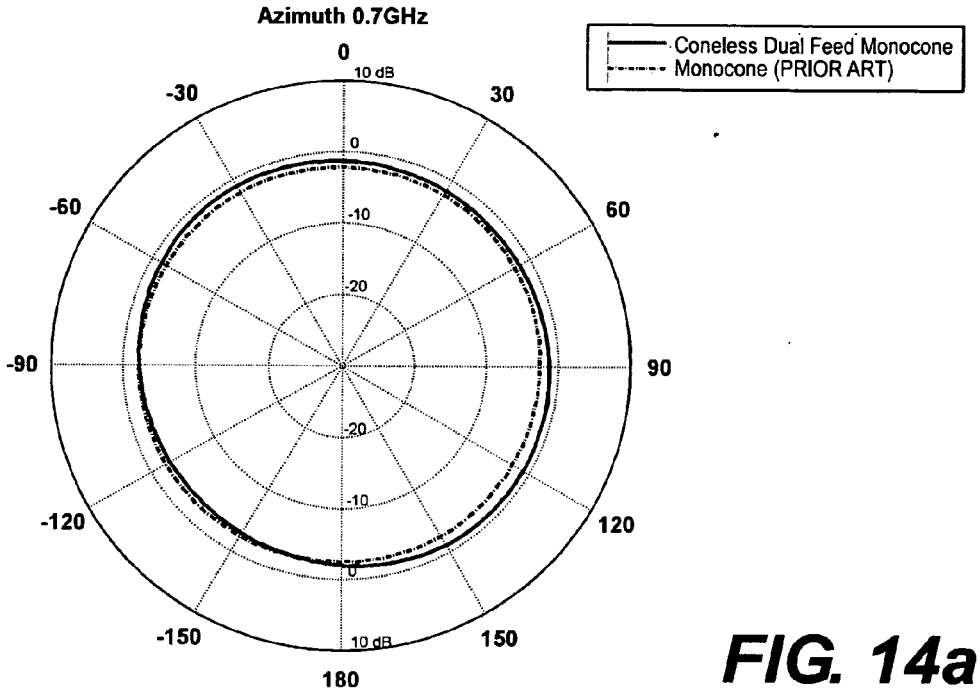
FIG. 14*a* depicts a graph, at 0.7 GHz, comparing the azimuth radiation patterns of a prior art monocone antenna with a monocone antenna system having a coneless cylindrical dual feed element according to a first embodiment of the present invention.
Figure 14B:
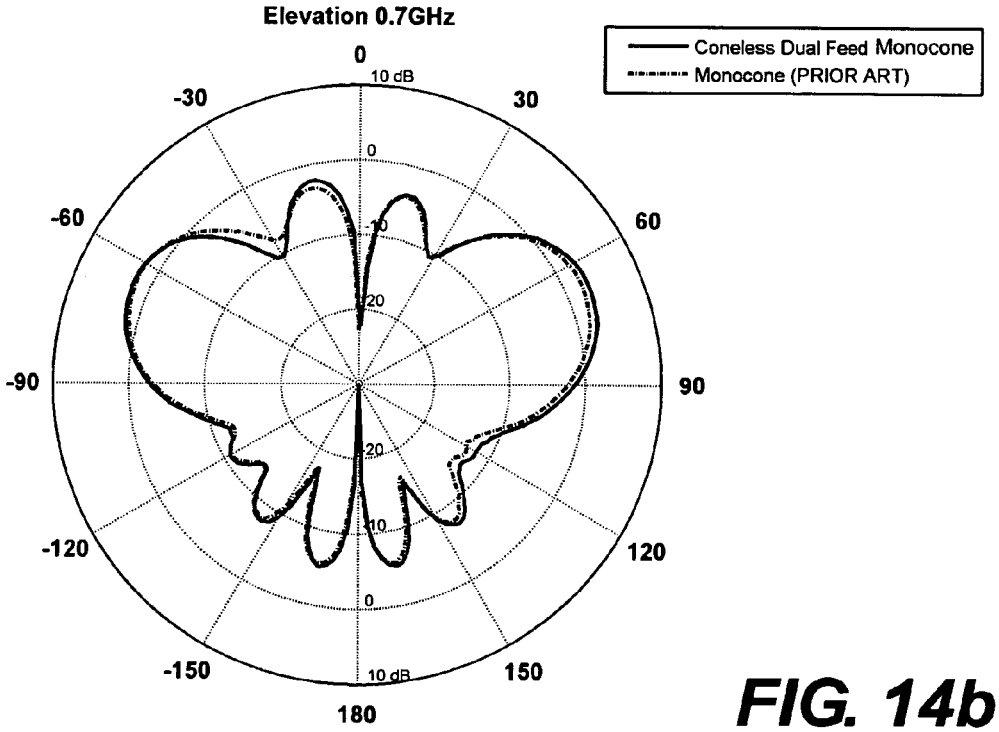
FIG. 14*b* depicts a graph, at 0.7 GHz, comparing the elevation radiation patterns of a prior art monocone antenna with a modified monocone antenna system having a coneless cylindrical dual feed element according to a first embodiment of the present invention.

Referring now to FIGS. 14*a* and 14*b*, two graphs depict the azimuth and elevation radiation patterns, respectively, of a preferred embodiment of coneless monocone antenna system 1, having a coneless cylindrical dual feed element, and a typical prior art monocone antenna at 0.7 GHz, showing that the pattern shape and gain are nearly identical.

Figure 15A:
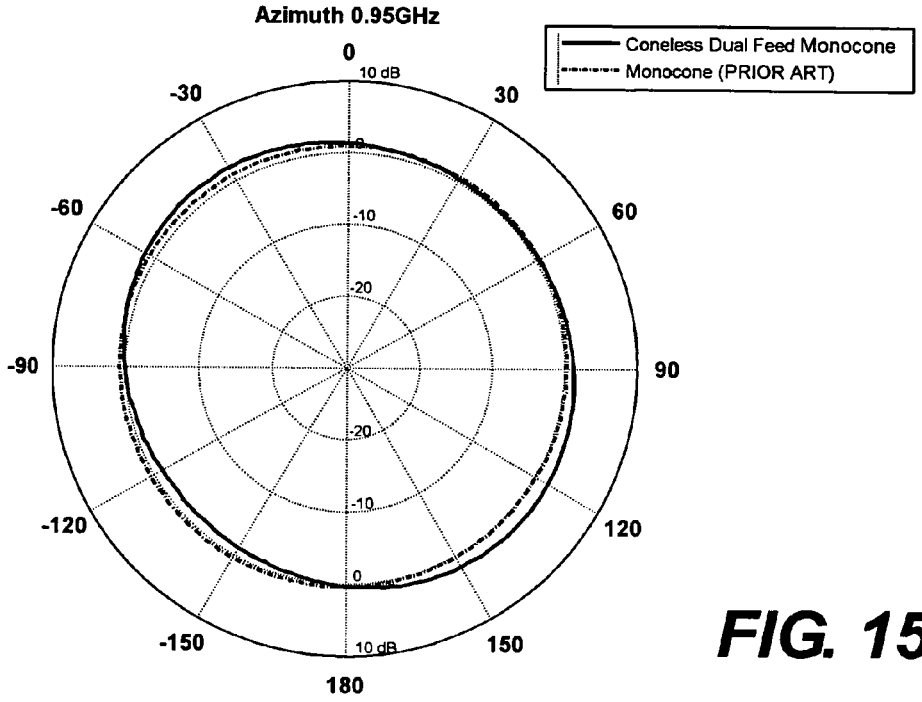
FIG. 15*a* depicts a graph, at 0.95 GHz, comparing the azimuth radiation patterns of a prior art monocone antenna with a modified monocone antenna system having a coneless cylindrical dual feed element according to a first embodiment of the present invention.
Figure 15B:
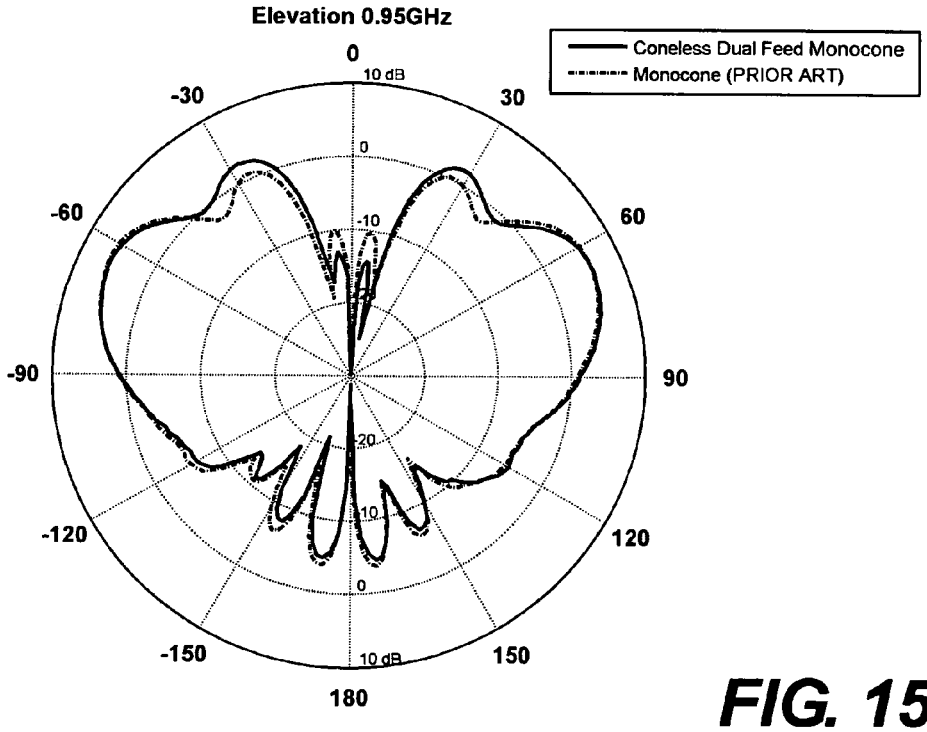
FIG. 15*b* depicts a graph, at 0.95 GHz, comparing the elevation radiation patterns of a prior art monocone antenna with a modified monocone antenna system having a coneless cylindrical dual feed element according to a first embodiment of the present invention.

Referring now to FIGS. 15*a* and 15*b*, two graphs depict the azimuth and elevation radiation patterns, respectively, of a preferred embodiment of coneless monocone antenna system 1, having a coneless cylindrical dual feed element, and a typical prior art monocone antenna at 0.95 GHz, showing that the pattern shape and gain are nearly identical.

Figure 16A:
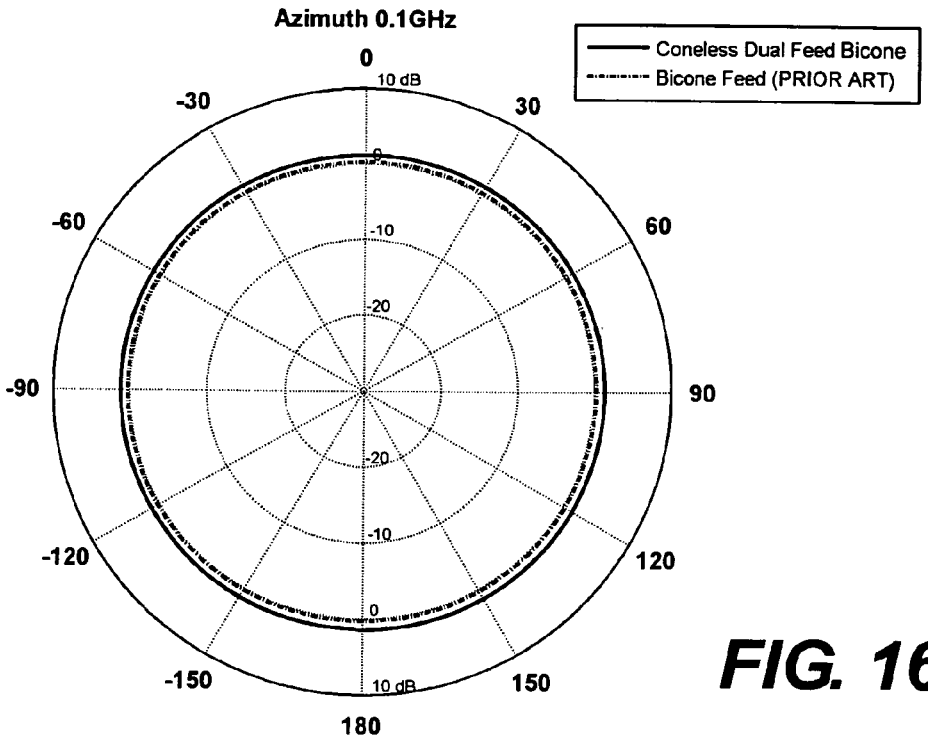
FIG. 16*a* depicts a graph, at 0.1 GHz, comparing the azimuth radiation patterns of a prior art biconical antenna with a modified biconical antenna system having coneless cylindrical dual feed elements according to a second embodiment of the present invention.
Figure 16B:
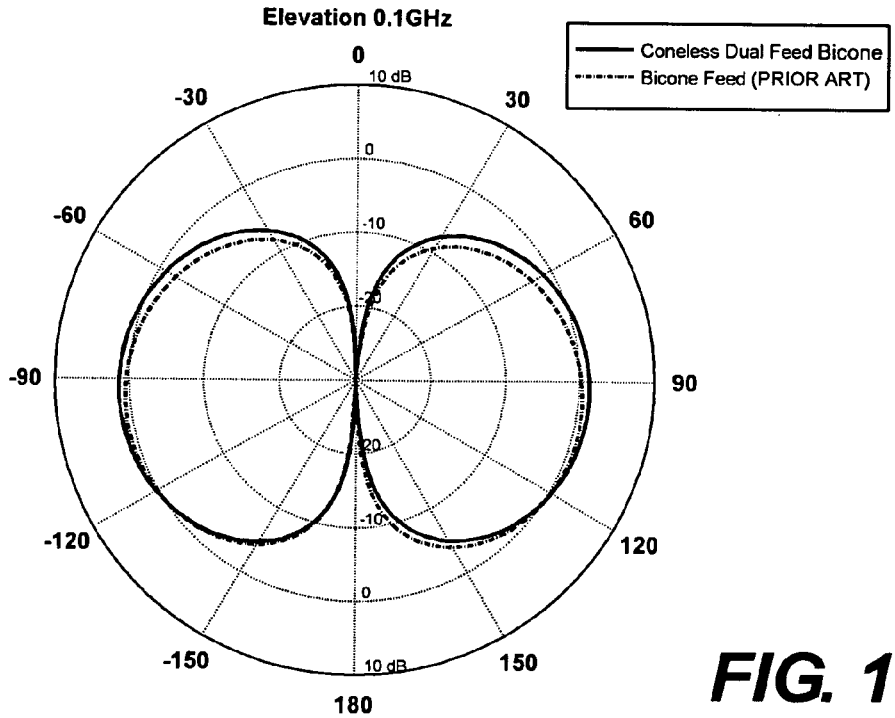
FIG. 16*b* depicts a graph, at 0.1 GHz, comparing the elevation radiation patterns of a prior art biconical antenna with a modified biconical antenna system having coneless cylindrical dual feed elements according to a second embodiment of the present invention.

Referring now to FIGS. 16*a* and 16*b*, two graphs depict the azimuth and elevation radiation patterns, respectively, of a preferred embodiment of coneless biconical antenna system 2, having coneless cylindrical dual feed elements, and a typical prior art biconical antenna at 0.1 GHz, showing that the pattern shape and gain are nearly identical.

Figure 17A:
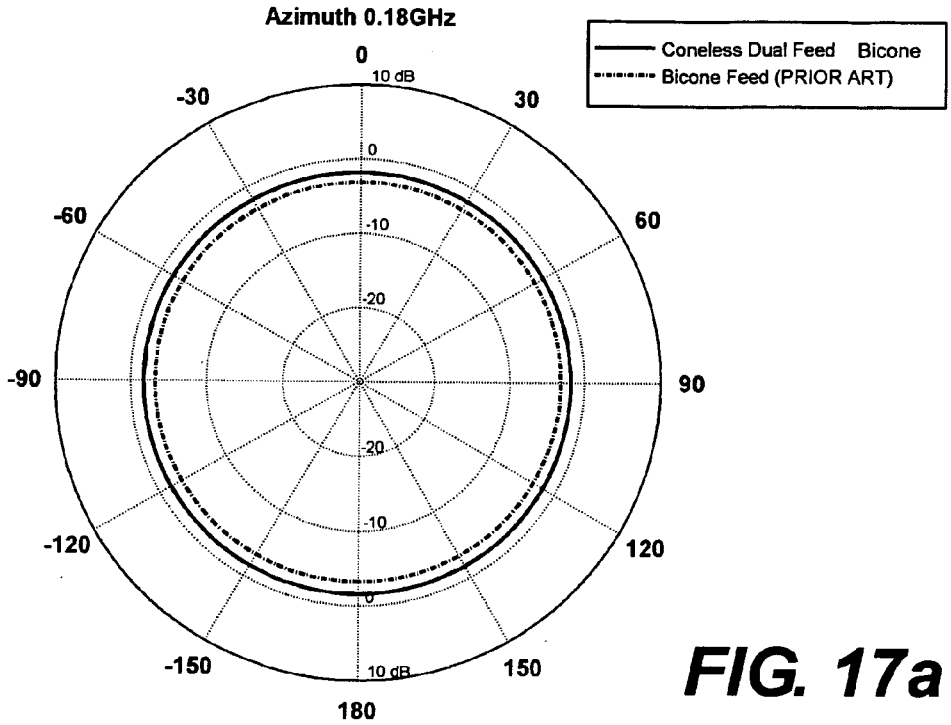
FIG. 17*a* depicts a graph, at 0.18 GHz, comparing the azimuth radiation patterns of a prior art biconical antenna with a modified biconical antenna system having coneless cylindrical dual feed elements according to a second embodiment of the present invention.
Figure 17B:
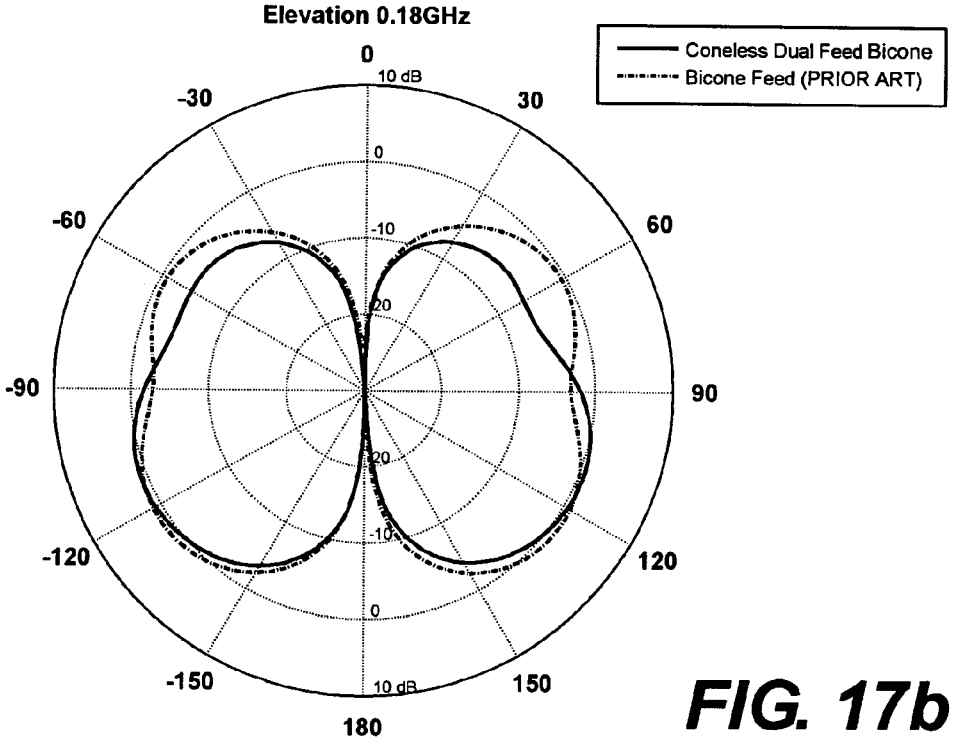
FIG. 17*b* depicts a graph, at 0.18 GHz, comparing the elevation radiation patterns of a prior art biconical antenna with a modified biconical antenna system having coneless cylindrical dual feed elements according to a second embodiment of the present invention.

Referring now to FIGS. 17*a* and 17*b*, two graphs depict the azimuth and elevation radiation patterns, respectively, of a preferred embodiment of coneless biconical antenna system 2, having coneless cylindrical dual feed elements, and a typical prior art biconical antenna at 0.18 GHz, showing that the pattern shape and gain are nearly identical in azimuth and very similar in elevation.

Figure 18A:
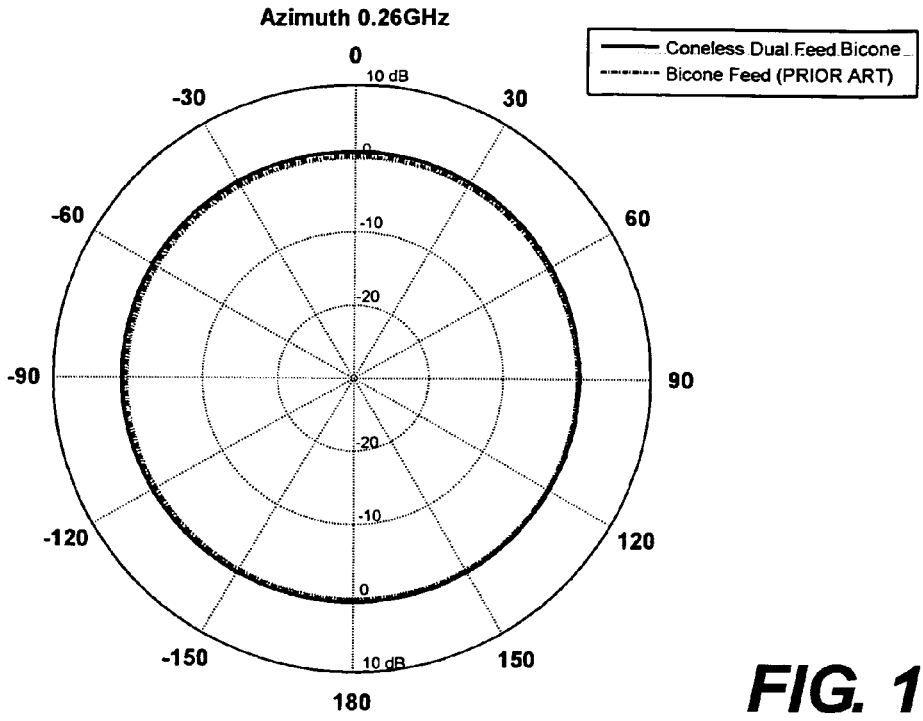
FIG. 18*a* depicts a graph, at 0.26 GHz, comparing the azimuth radiation patterns of a prior art biconical antenna with a modified biconical antenna system having coneless cylindrical dual feed elements according to a second embodiment of the present invention.
Figure 18B:
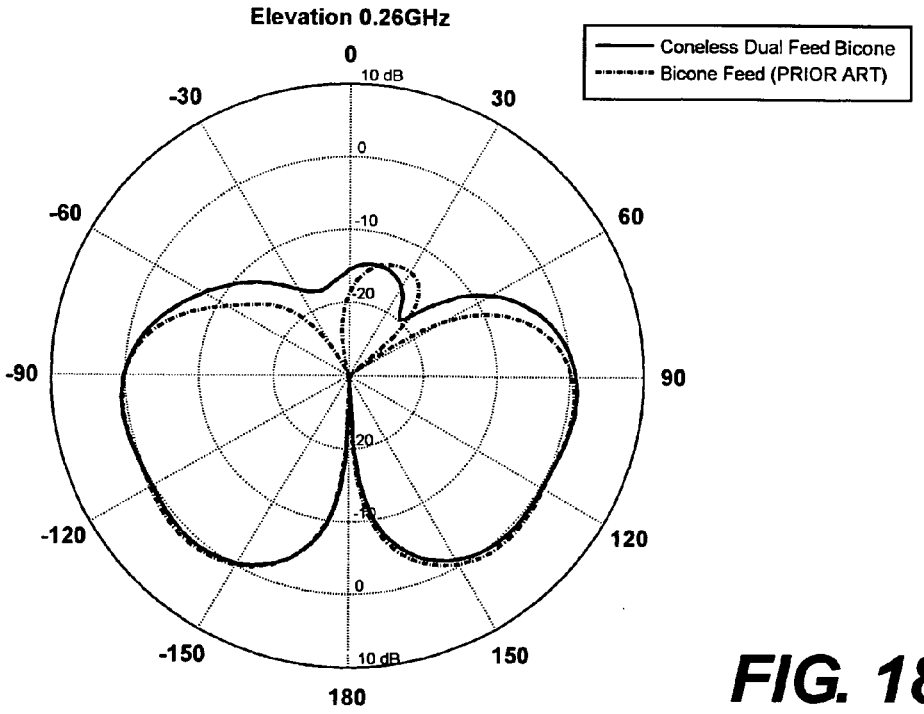
FIG. 18*b* depicts a graph, at 0.26 GHz, comparing the elevation radiation patterns of a prior art biconical antenna with a modified biconical antenna system having coneless cylindrical dual feed elements according to a second embodiment of the present invention.

Referring now to FIGS. 18*a* and 18*b*, two graphs depict the azimuth and elevation radiation patterns, respectively, of a preferred embodiment of coneless biconical antenna system 2, having coneless cylindrical dual feed elements, and a typical prior art biconical antenna at 0.26 GHz, showing that the pattern shape and gain are nearly identical in azimuth and very similar in elevation.

Figure 19A:
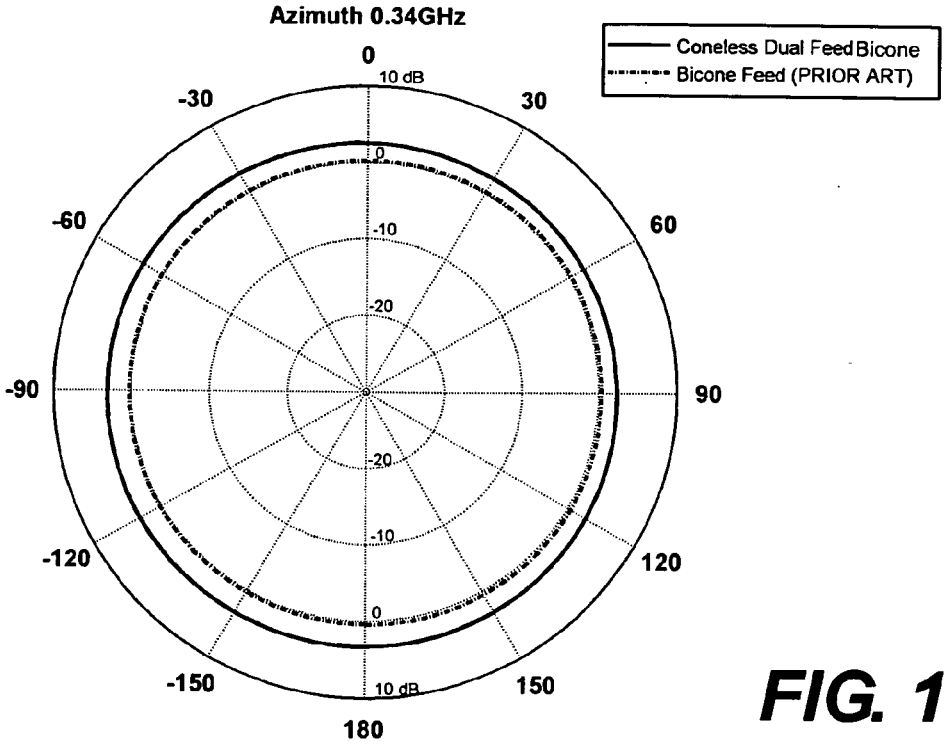
FIG. 19*a* depicts a graph, at 0.34 GHz, comparing the azimuth radiation patterns of a prior art biconical antenna with a modified biconical antenna system having coneless cylindrical dual feed elements according to a second embodiment of the present invention.
Figure 19B:
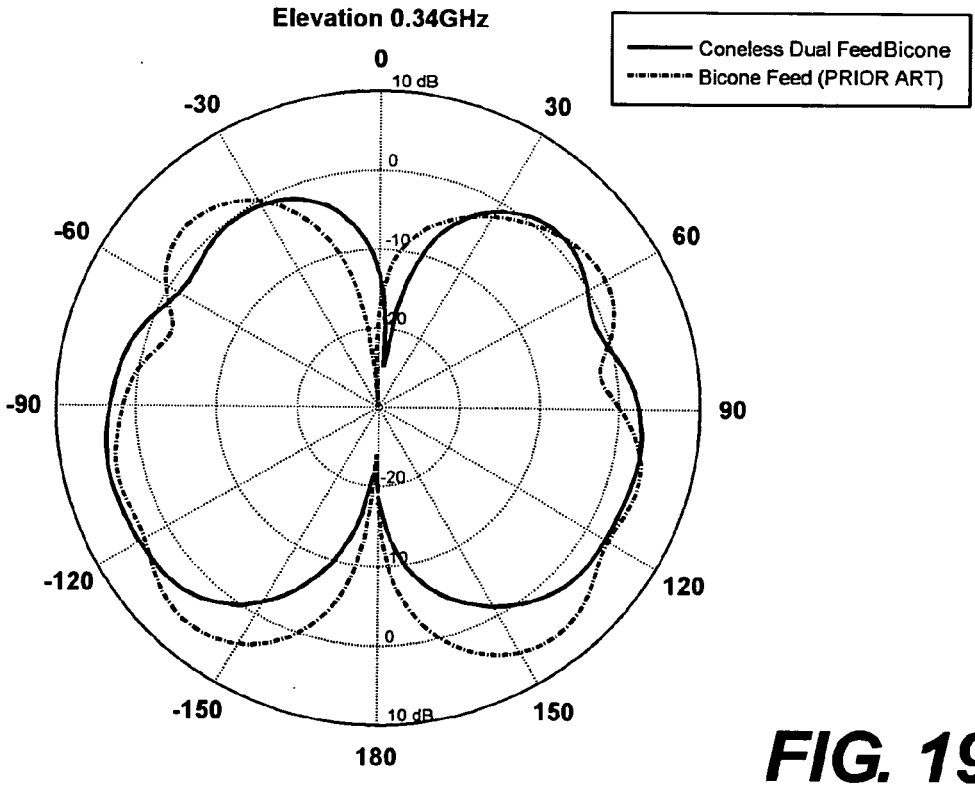
FIG. 19*b* depicts a graph, at 0.34 GHz, comparing the elevation radiation patterns of a prior art biconical antenna with a modified biconical antenna system having coneless cylindrical dual feed elements according to a second embodiment of the present invention.

Referring now to FIGS. 19*a* and 19*b*, two graphs depict the azimuth and elevation radiation patterns, respectively, of a preferred embodiment of coneless biconical antenna system 2, having coneless cylindrical dual feed elements, and a typical prior art biconical antenna at 0.34 GHz, showing that the pattern shape and gain are very similar.

Figure 20A:
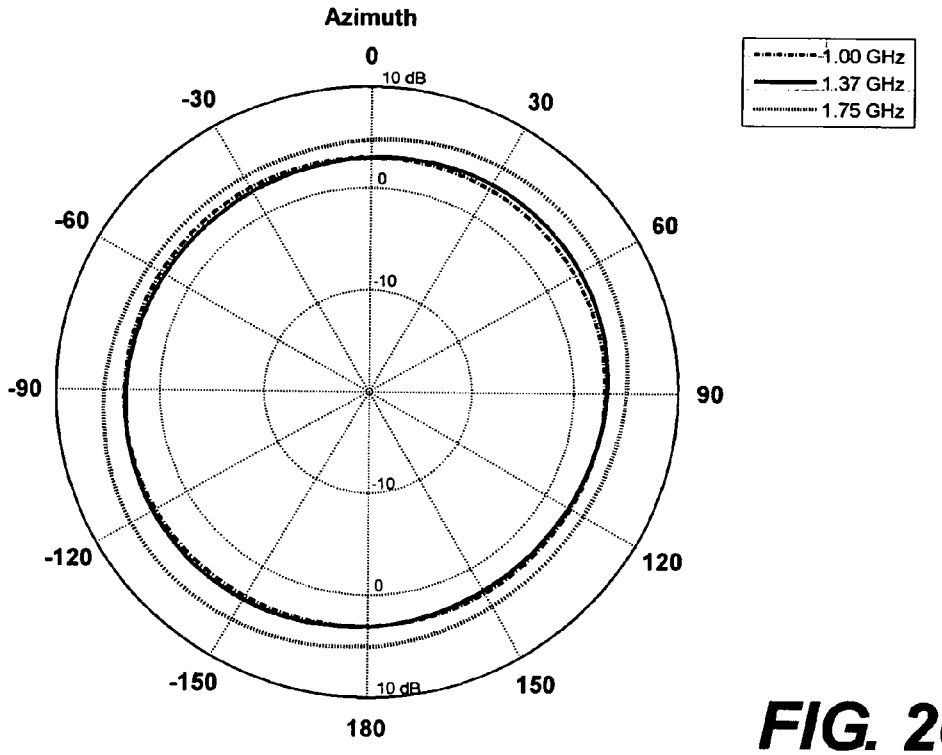
FIG. 20*a* depicts a graph, at 1.00 GHz, 1.37 GHz and 1.75 GHz, of the azimuth radiation patterns of a stacked collinear triple modified biconical antenna system having coneless cylindrical dual feed elements and a collinear generic element stacked on the upper biconical element, according to a seventh embodiment of the present invention.
Figure 20B:
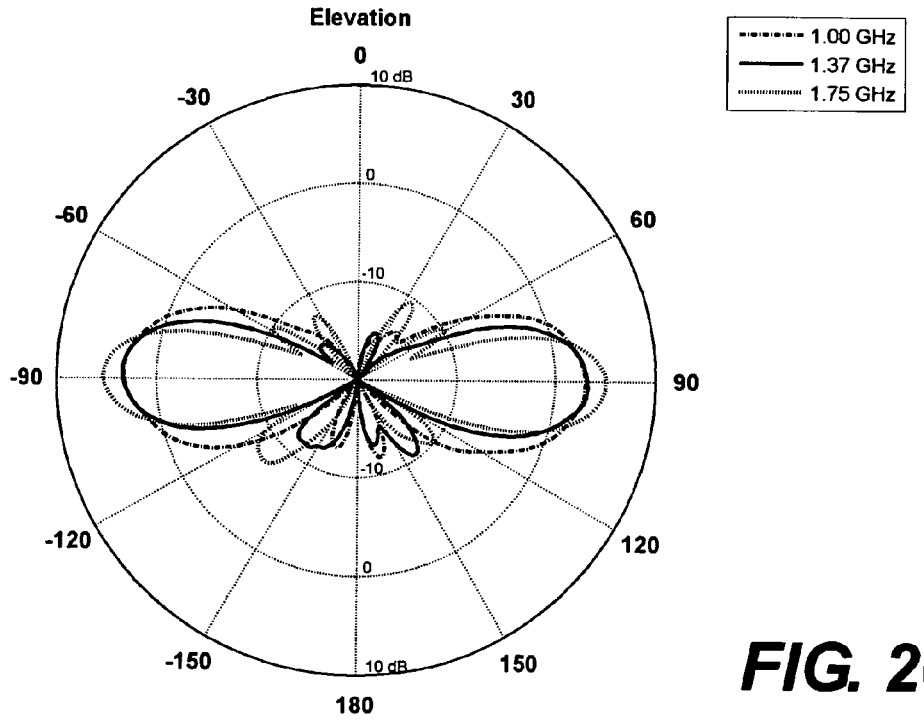
FIG. 20*b* depicts a graph, at 1.00 GHz, 1.37 GHz and 1.75 GHz, of the elevation radiation patterns of a stacked collinear triple modified biconical antenna system having coneless cylindrical dual feed elements and a collinear generic device stacked on the upper biconical element, according to a fifth embodiment of the present invention.

Referring now to FIGS. 20*a* and 20*b*, two graphs depict the azimuth and elevation radiation patterns, respectively, of a preferred embodiment of coneless biconical antenna system with stacked device 8, having three coneless dual feed biconical antennas and one or more additional devices stacked in a collinear array, at three frequencies of interest, 1.00 GHz, 1.37 GHz and 1.75 GHz. The graphs show that the patterns and gain are stable over this range, narrowing slightly as the frequency increases, as is generally desirable. Further, the graphs show that performance is comparable to prior art.

It will be apparent to those skilled in that art that various modifications and variations can be made in the fabrication and configuration of the present invention without departing from the scope and spirit of the invention. For example, the design of the present invention contemplates one or multiple tapered feed points for the coneless radiator. While a preferred embodiment discloses two tapered feed points, three, four, five, six, seven or eight or more feed points are all considered within the scope of the invention. Because the highest frequency of operation is determined by the diameter of the coneless cylinder and the number of feed points, the diameter and number may be adjusted as desired for preferred frequencies.

As another variation, the coneless biconical element of the present invention may be incorporated with an asymmetrical dipole to form a monopole, thus providing an ultra-broadband antenna system of virtually infinite bandwidth. The cylinder of this variation may be formed from inexpensive G10 dielectric plastic (fiberglass) with copper cladding that is rolled into the cylindrical shape. The Duroid balun, which may also be an etched, microwave substrate with copper cladding, may be positioned along the center axis of the rolled G10 cylinder and fed at the tips of the etched features of the G10 board.

As another variation, two or three or more of the coneless biconical elements of the present invention may be stacked together, along with a high-gain omni-directional antenna at a given frequency band on top, and additional elements may be placed above and below the coneless biconical elements to cover additional frequency bands.

As another variation, the coneless biconical element of the present invention may be utilized in multiple frequency bands.

In addition, a variety of materials may be used to fabricate the components of the invention. For example, stealth materials, such as carbon-based compounds, may be used in order to reduce detection. The conductor surfaces may be replaced with frequency-selective surfaces whereby the surfaces act as conductors in selected frequency bands and also act as RF reactance (non-perfect conductors) at other bands.

As embodied herein, the antenna system of the present invention may be provided with any type of RF transceivers or transponders, such as radios, GPS receivers or radars; other antenna systems such as SATCOM; cameras, IR sensors, lights, and audio equipment; digital devices; as well as other electrical or mechanical devices operated by hydraulic, pneumatic or mechanical controls or actuators, or operated by a gas, liquid or solid material transfer system. Thus, the antenna system of the present invention may be used for a wide variety of applications in RF transmission and reception, navigation, communication, direction finding, radar, and electronic warfare. Thus, it is intended that the present invention cover the modifications and variations of the invention provided they come within the scope of the appended claims and their equivalents.

What is claimed is:

1. A broadband antenna system comprising at least one radiating element having:

a hollow radiating portion with a first circumference and a second circumference;

a hollow cylindrical feed portion with a third circumference, an upper edge connected to said second circumference of said radiating element, a cutaway lower edge, and comprising at least two tapered feed points;

and a first at least one operating structure connected to and operating said hollow cylindrical feed portion;

wherein said at least two tapered feed points are disposed on said cutaway lower edge of said third circumference of said hollow cylindrical feed portion.

2. The broadband antenna system according to claim 1, wherein said first at least one operating structure further comprises at least one from the group consisting of a feed line, a coaxial cable, a transmission line, a twin lead, a stripline, and a microstrip.

3. The broadband antenna system according to claim 2, wherein said at least one radiating element is a monocone disposed on a ground plane.

4. The broadband antenna system according to claim 2, wherein said at least one radiating element is a bicone having a balun.

5. The broadband antenna system according to claim 2, further comprising:

at least one device collinear to said at least one radiating element;

a second at least one operating structure, disposed within said at least one radiating element and connected to said at least one device; and wherein said at least one device is operated by said second at least one operating structure.

6. The broadband antenna system according to claim 5, wherein said second at least one operating structure further comprises at least one from the group consisting of a feed line, a coaxial cable, a power cable, a digital cable, a fiber optic cable, a wire, piping, tubing, a mechanical actuator, a gas transfer system, a liquid transfer system, and a solid material transfer system.

7. The broadband antenna system according to claim 6, wherein said at least one radiating element is a monocone disposed on a ground plane.

8. The broadband antenna system according to claim 6, wherein said at least one radiating element is a bicone having a balun.

9. The broadband antenna system according to claim 6, wherein said at least one device further comprises at least one bicone, and wherein a plurality of said at least one bicone is stacked collinearly, is separated by a dielectric isolator therebetween each of said plurality of said bicone, and is operated by a plurality of said second at least one operating structure.

10. The broadband antenna system according to claim 2, further comprising a plurality of said at least two tapered feed points, and wherein the circumferential distance between each of said plurality of said at least two tapered feed points and an adjacent feed point is less than ½ wavelength of the highest frequency of operation.

11. A broadband antenna system comprising at least one radiating element having:

a hollow radiating portion;

a hollow feed portion comprising at least two tapered feed points;

and a first at least one operating structure connected to and operating said hollow feed portion;

wherein said hollow radiating portion is cylindrical with a first circumference, said hollow feed portion is cylindrical with a second circumference coincident with said first circumference of said hollow radiating portion, and wherein said at least two tapered feed points are disposed on said second circumference of said hollow feed portion.

12. The broadband antenna system according to claim 11, wherein said first at least one operating structure further comprises at least one from the group consisting of a feed line, a coaxial cable, a transmission line, a twin lead, a stripline, and a microstrip.

13. The broadband antenna system according to claim 12, wherein said at least one radiating element is a monocone disposed on a ground plane.

14. The broadband antenna system according to claim 12, wherein said at least one radiating element is a bicone having a balun.

15. The broadband antenna system according to claim 14, wherein said balun is vertically disposed.

16. The broadband antenna system according to claim 14, wherein said balun is horizontally disposed.

17. The broadband antenna system according to claim 14, wherein said balun is an integrated wraparound balun that is vertically disposed in said at least one bicone, and wherein said at least one bicone is formed by rolling a flexible microwave substrate material.

18. The broadband antenna system according to claim 12, further comprising:

at least one device collinear to or coaxial with said at least one radiating element;

a second at least one operating structure, disposed within said at least one radiating element and connected to said at least one device; and wherein said at least one device is operated by said second at least one operating structure.

19. The broadband antenna system according to claim 18, wherein said second at least one operating structure further comprises at least one from the group consisting of a feed line, a coaxial cable, a transmission line, a twin lead, a stripline, and a microstrip, a power cable, a digital cable, a fiber optic cable, a wire, piping, tubing, a mechanical actuator, a gas transfer system, a liquid transfer system, and a solid material transfer system.

20. The broadband antenna system according to claim 19, wherein said at least one radiating element is a monocone disposed on a ground plane.

21. The broadband antenna system according to claim 19, wherein said at least one radiating element is a bicone having a balun.

22. The broadband antenna system according to claim 19, wherein said at least one device further comprises at least one bicone, and wherein a plurality of said at least one bicone is stacked collinearly, is separated by a dielectric isolator therebetween each of said plurality of said bicone, and is operated by a plurality of said second at least one operating structure.

23. The broadband antenna system according to claim 19, wherein said at least one device is a radiating antenna.

24. The broadband antenna system according to claim 19, wherein said at least one device further comprises at least one from the group consisting of an antenna element, a GPS system, a camera, an IR sensor, a light, an audio device, a radar device, and a communications system.

25. The broadband antenna system according to claim 21, wherein said balun is vertically disposed.

26. The broadband antenna system according to claim 21, wherein said balun is horizontally disposed.

27. The broadband antenna system according to claim 21, wherein said balun is an integrated wraparound balun that is vertically disposed in said at least one bicone, and wherein said at least one bicone is formed by rolling a flexible microwave substrate material.

28. The broadband antenna system according to claim 12, further comprising a plurality of said at least two tapered feed points, and wherein the circumferential distance between each of said plurality of said at least two tapered feed points and an adjacent feed point is less than ½ wavelength of the highest frequency of operation.

29. The broadband antenna system according to claim 5, wherein, when said at least one device is operated by said second at least one operating structure, the azimuth pattern of said at least one radiating element varies less than +/−3 dB over a frequency range having a ratio of 1.0 to 1.75.

30. The broadband antenna system according to claim 18, wherein, when said at least one device is operated by said second at least one operating structure, the azimuth pattern of said at least one radiating element varies less than +/−3 dB over a frequency range having a ratio of 1.0 to 1.75.

* * * * *